US007603937B2

(12) United States Patent
Pavlik et al.

(10) Patent No.: US 7,603,937 B2
(45) Date of Patent: Oct. 20, 2009

(54) DISPENSER FOR WEB MATERIAL

(75) Inventors: Rudolf Pavlik, Millersburg, PA (US); Victor J. DesRosiers, Kinderhook, NY (US)

(73) Assignee: Sonoco Development, Inc., Hartsville, SC (US)

( * ) Notice: Subject to any disclaimer, the term of this patent is extended or adjusted under 35 U.S.C. 154(b) by 340 days.

(21) Appl. No.: 11/422,961

(22) Filed: Jun. 8, 2006

(65) Prior Publication Data

US 2007/0000935 A1 Jan. 4, 2007

Related U.S. Application Data

(60) Provisional application No. 60/689,177, filed on Jun. 10, 2005, provisional application No. 60/717,076, filed on Sep. 14, 2005.

(51) Int. Cl.
*B26D 1/04* (2006.01)
*B65H 75/32* (2006.01)

(52) U.S. Cl. ..... 83/614; 83/649

(58) Field of Classification Search ..... 83/648, 83/649, 614; 225/39, 42, 43, 47, 49, 31
See application file for complete search history.

(56) References Cited

U.S. PATENT DOCUMENTS

| | | | | |
|---|---|---|---|---|
| 2,334,997 | A | | 11/1943 | Doll |
| 2,823,969 | A | | 2/1958 | Traver et al. |
| 3,044,338 | A | | 7/1962 | Horton et al. |
| D197,413 | S | | 1/1964 | Castelli |
| 3,142,217 | A | | 7/1964 | Busse |
| 3,199,394 | A | | 8/1965 | Castelli |
| 3,240,093 | A | | 3/1966 | Bell, Jr. et al. |
| 3,587,412 | A | | 6/1971 | Thomas et al. |
| 3,688,625 | A | | 9/1972 | Thomas et al. |
| 3,698,548 | A | * | 10/1972 | Stenzel et al. ..... 242/588.4 |
| 4,156,382 | A | | 5/1979 | Baker |
| 4,197,774 | A | | 4/1980 | Singh et al. |
| 4,245,536 | A | | 1/1981 | Urion |
| 4,787,284 | A | | 11/1988 | Chen |
| 4,957,023 | A | | 9/1990 | Chen |

(Continued)

FOREIGN PATENT DOCUMENTS

| | | |
|---|---|---|
| DE | 87 06 970 | 8/1987 |

(Continued)

OTHER PUBLICATIONS

The European Search Reports for European Application No. 07014425.8, 07014426.6 and 07014427.4.

(Continued)

*Primary Examiner*—Stephen Choi
(74) *Attorney, Agent, or Firm*—Alston & Bird LLP

(57) ABSTRACT

A container for dispensing selected portions of a web material and a method of making such a container. The container is arranged to contain the web material and has an opening through which the web material can be led out of the container. A track is positioned such that web material led out of the container through the opening can be laid across the track. A cutter is capable of sliding along the track and of cutting web material laid across the track. At least in a packaged configuration for shipping, the track and cutter do not extend beyond an outline of the container.

9 Claims, 21 Drawing Sheets

U.S. PATENT DOCUMENTS

| | | | | |
|---|---|---|---|---|
| 5,025,692 | A | 6/1991 | Reynolds | |
| 5,036,740 | A | 8/1991 | Tsai | |
| 5,044,241 | A | 9/1991 | Labrecque | |
| 5,440,961 | A | 8/1995 | Lucas, Jr. et al. | |
| 5,758,559 | A | 6/1998 | Capitao, Jr. et al. | |
| 6,105,481 | A | 8/2000 | Schuler | |
| D494,859 | S | 8/2004 | Keberlein | |
| 6,966,473 | B1 * | 11/2005 | Hayden | 225/39 |
| 7,000,520 | B2 * | 2/2006 | Nichols et al. | 83/614 |
| 2002/0117038 | A1 | 8/2002 | Vegliante et al. | |
| 2003/0140760 | A1 | 7/2003 | Bory | |
| 2004/0007606 | A1 | 1/2004 | Baker, Jr. | |
| 2004/0040429 | A1 | 3/2004 | Nichols et al. | |
| 2004/0237746 | A1 | 12/2004 | Schultz et al. | |
| 2005/0005755 | A1 | 1/2005 | Turvey et al. | |
| 2005/0034584 | A1 | 2/2005 | Antal et al. | |
| 2005/0034585 | A1 | 2/2005 | Antal | |
| 2005/0035133 | A1 | 2/2005 | Gerulski et al. | |
| 2005/0166738 | A1 | 8/2005 | Hsu | |

FOREIGN PATENT DOCUMENTS

| | | |
|---|---|---|
| DE | 197 02 250 | 7/1998 |
| DE | 101 30 578 | 1/2003 |
| GB | 2 370 032 | 6/2002 |
| JP | 03 187841 | 8/1991 |
| JP | 09 221143 | 8/1997 |
| WO | WO 03/106121 | 12/2003 |
| WO | WO 2004/108572 | 12/2004 |
| WO | WO 2004/110709 | 12/2004 |
| WO | WO 2004/110710 | 12/2004 |
| WO | WO 2005/073107 | 8/2005 |

OTHER PUBLICATIONS

The European Search Report for European Application No. 0625297.3; Filed Jun. 9, 2006; Date of Completion Sep. 18, 2006.

* cited by examiner

DISPENSER FOR WEB MATERIAL

CROSS-REFERENCE TO RELATED APPLICATIONS

This application claims the benefit of the filing date of U.S. Provisional Patent Application Ser. No. 60/689,177 filed on Jun. 10, 2005, and U.S. Provisional Patent Application Ser. No. 60/717,076 filed on Sep. 14, 2005.

BACKGROUND OF THE INVENTION

The present invention relates to dispensers for web materials, such as plastic film. In particular, the invention relates to containers having a cutting device for cutting across the material as it is dispensed.

Various containers are known for dispensing web material. Many of these containers use an exposed serrated edge as the means for cutting the web material once dispensed from the container. These serrated edges have several disadvantages. For example, the sharp, exposed serrated edge can inadvertently cut the user or other material that it contacts. Also, the user must engage the web material with the serrated edge by holding the web material in one hand and the container in the other. This awkward arrangement can lead to adverse results such as ineffective cutting, the web material doubling over itself, and so on.

Some known containers include a track-guided cutting assembly to overcome the problems associated with the use of a serrated edge. An example of such a container is described in commonly assigned U.S. Patent Application Publication No. U.S. 2005/0034585, in the name of Keith E. Antal, said application being herein incorporated by reference. This application describes a box for a roll of web material, with a molded plastic track extending along the box, parallel to the axis of the roll. A cutter is captive in the track. The web material is led out of the box and across the track. The cutter is slid along the track, cutting across the material.

The track described in the above-mentioned application of Antal is seated in a slot formed in one side of the box. The slot may weaken the box, and the Antal application proposes an additional reinforcing member. In addition, part of the height of the track, and part of the height of the cutter, project above the side of the box. The projecting parts may be inconvenient for packing and stacking the boxes, unless each box is enclosed in a larger lid.

BRIEF SUMMARY OF THE INVENTION

The present invention in one aspect relates generally to a container for dispensing selected portions of a web material retained within the container. The container has an elongated opening in a wall thereof, through which the web material can be led out of the container. A track is positioned on the exterior parallel to the slot so that the web material can be laid across the track. A cutter slides along the track to cut across the web material. At least in a packaged configuration for shipping, the container has a compact geometrical profile, and the track and cutter do not extend beyond that profile.

In one embodiment, two adjacent sides of the container are folded inwards to form a recess along the edge where the two sides meet. The track is positioned within the recess, engaging both of the folded inward sides of the recess.

In another embodiment, parts of two adjacent sides are folded inwards to form a recess along the edge where the two sides meet. Parts of the two adjacent sides at the ends of the recess are not folded inwards. The track is positioned within the recess. The ends of the track are retained under the unfolded parts of the sides.

In another embodiment, the track and cutter do not project outward of imaginary continuations of the two adjacent sides over the recess. A removable cover is provided over the track and cutter, generally following the outline of the container profile without the recess.

In a further embodiment, the cutter runs in a slot or cutter guide in the track. The cutter has a projecting portion or handle by which a user can grip the cutter. The cutter is configured to be rotatable or foldable into a shipping position to reduce the profile of the cutter assembly during shipping.

In a further embodiment, the track is mounted on a part of the container that is movable between a shipping position in which the cutter track is inside the exterior profile of the container and an operative position in which the cutter track is outside the exterior profile of the container and faces outwards.

The present invention in another aspect relates generally to a container for dispensing selected portions of a web material retained within the container. The container has an elongate opening in a wall thereof, through which the web material can be led out of the container. A track is positioned on the exterior parallel to the slot so that the web material can be laid across the track. A cutter slides along the track to cut across the web material. Two adjacent sides of the container are folded inwardly to form a recess along the edge where the two sides meet. The track is positioned within the recess, engaging both of the inwardly folded sides of the recess.

The present invention in another aspect relates generally to a container for dispensing selected portions of a web material retained within the container. A track is positioned on the exterior so that the web material can be laid across the track. A cutter slides along the track to cut across the web material. The track is mounted bridging side edges of the container.

In one embodiment, the track has pairs of flanges along both sides of the track, and free edges of adjacent sides of the container are received between the flanges.

Other embodiments of the invention are also described herein and claimed in the appended claims.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
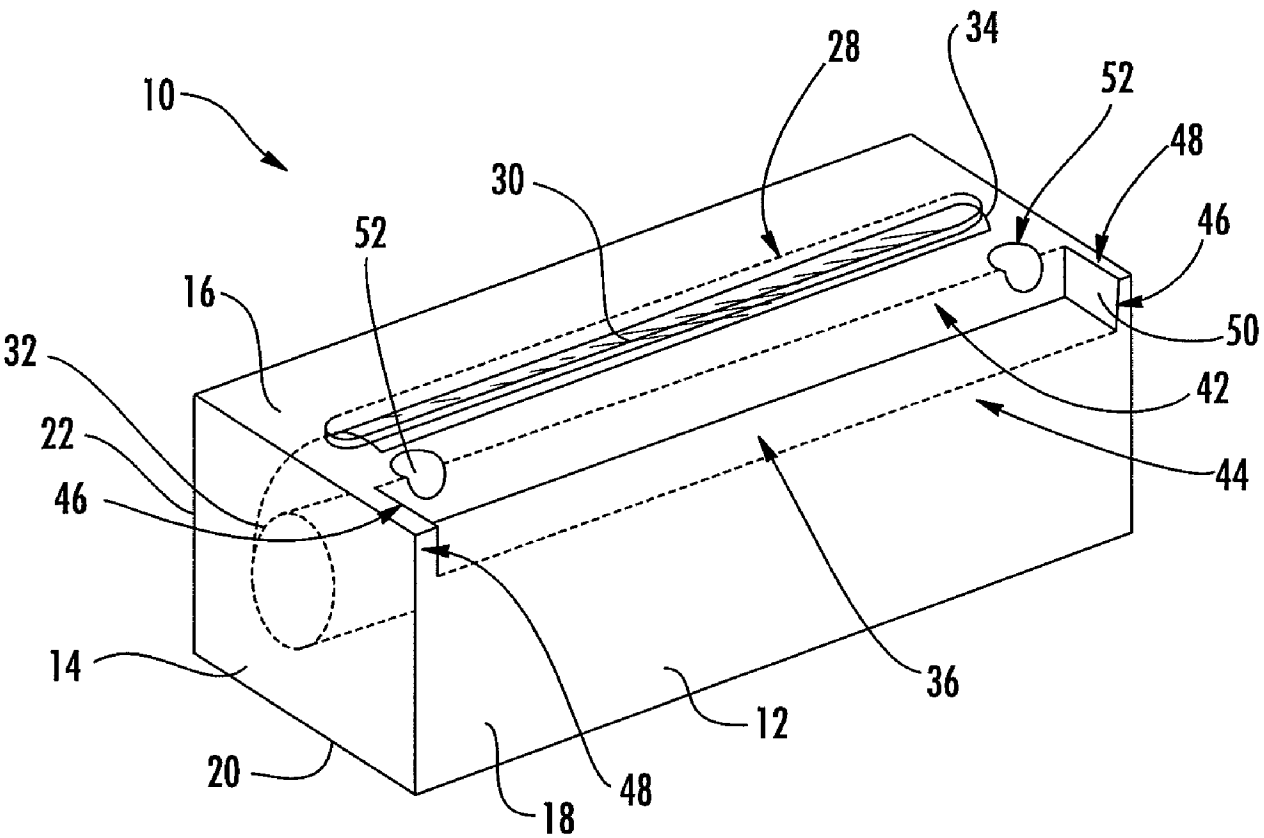
FIG. 1 is a perspective view of a first embodiment of a dispenser as contemplated by the invention.
Figure 2:
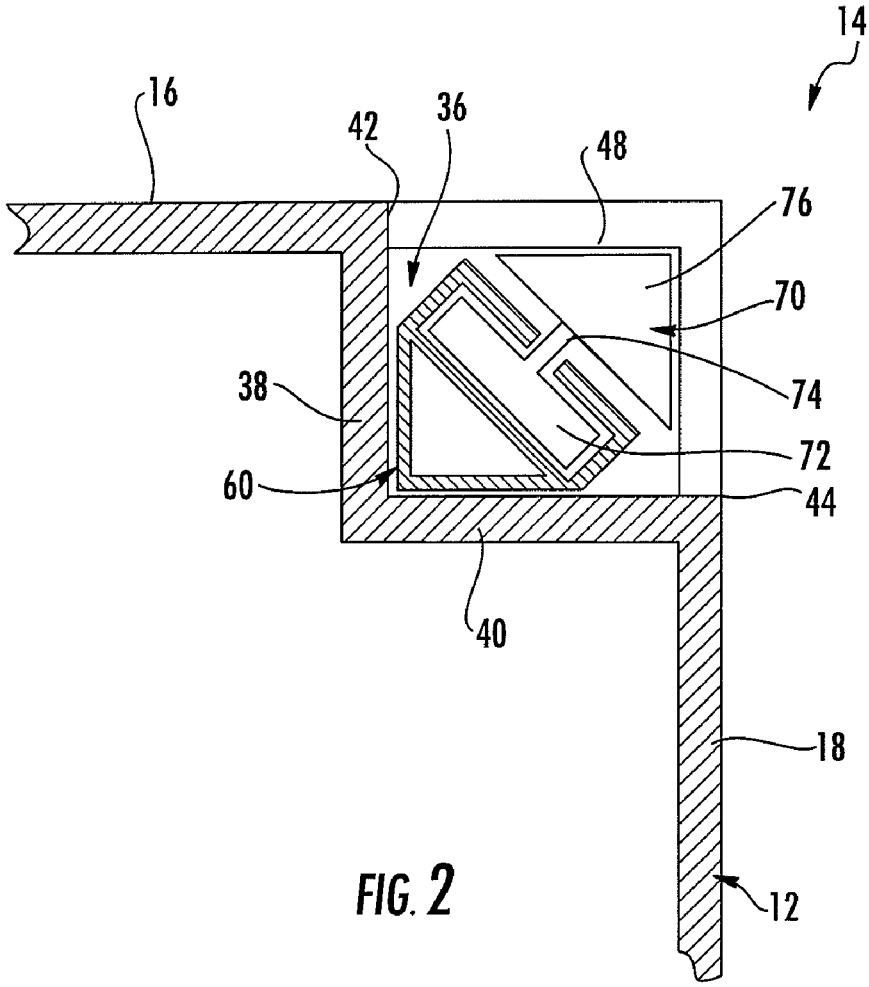
FIG. 2 is an enlarged section through part of the dispenser shown in FIG. 1, including a cutter assembly.

In the drawings, there are shown various embodiments of a container for storing and dispensing rolled web material, for example, plastic wrap. Referring to FIGS. 1 and 2 and initially especially to FIG. 1, a first form of container, identified generally by the numeral 10, comprises a box 12 that is long and thin and is approximately square in cross section. The box 12 has a body with two ends 14, three sides 16, 18, 20, and a lid 22. One long edge of each of the sides 16 and 20 joins the long edges of the side 18. The lid 22 is hinged to the other long edge of the side 20. The lid 22 may include a flap that tucks inside the side 20 when the box is closed or may be removed by means of perforations (not shown). The lid 22 can be opened for access to the interior of the box 12. A slot 28 is formed extending most of the length of the side 16. The slot 28 may be formed initially by scoring or otherwise forming a line of weakness through the material of the side 16, to define a strip that can be removed from the box 12 or a flap that can be raised to open or expose the slot 28.

In use, plastic film or other web material 30 is retained on a hollow core 32 positioned within the box 12. The web material 30 may be, for example, polyethylene film, polyvinyl chloride film, gift-wrap paper, freezer wrap paper, foil, or the like. The hollow core 32 may be supported for easy rotation on roll supports (not shown) formed on the insides of the ends 14. For shipping, the material 30 and the core 32 may be contained entirely within the closed box 12. For use, a free end 34 of the film material 30 is led off the core 32 and through the slot 28 to the exterior of the box: The free end 34 may be positioned by opening the box 12, opening the slot 28, feeding the film material 30 through the slot 28, and closing the lid 22.

Referring now especially to FIG. 2, a recess 36 is formed along the edge of the box 12 where the sides 16 and 18 meet. The recess 36 is formed by scoring the sides 16 and 18 parallel to the edge, and folding strips of material 38 and 40 inward at the score lines 42, 44. The fold that would otherwise form the convex edge between the sides 16, 18 is inverted to form a concave edge between the strips 38, 40. The ends of the strips 38, 40 are formed by cuts 46 through the material of the sides 16, 18 a short distance from the box ends 14, so that at each end of the recess there is a short overhang section 48 where the sides 16, 18 extend to meet at a convex edge of the box. An opening 50 is formed between the recess 36 and the interior of the box 12 under the overhang 48. Further openings 52 are illustrated in the box side 16 (top) near each end of the recess 36 and serve as finger holes for assisting in grabbing web material. Alternatively, overhangs 48 may be omitted, with the recess 36 continuing to the box ends 14.

Figure 3:
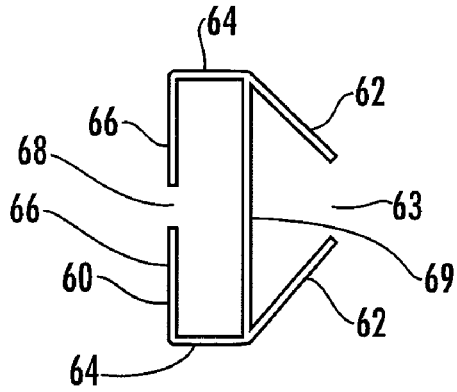
FIG. 3 is a section through a cutter rail forming part of the cutter assembly shown in FIG. 1.

Referring to FIGS. 2 and 3, a track or rail 60 is positioned in the recess 36. The rail 60 is generally pentagonal in cross section, with two basal faces 62 formed approximately at right angles. The basal faces 62 preferably do not meet, but form a gap 63 between them. Two substantially parallel side walls 64 extend from the outer edges of the basal faces 62. Two substantially coplanar distal faces 66 extend inwards from the distal edges of the side walls 64 and form between them a slot 68. The two sides of the rail 60 are connected by a transverse wall 69. The rail 60 is positioned in the recess 36, with the basal faces 62 positioned flat against the strips 38, 40 forming the recess 36. The gap 63 allows flexibility if the basal faces 62 are not at exactly the same angle as the box strips 38, 40. The rail 60 is so dimensioned that the entire rail 60 is inside the effective profile extension of the box sides 16, 18 above the recess 36. The distal faces 66 are outside an imaginary plane joining the fold lines 42, 44 at the edges of the recess, so that web material can readily be laid across the rail 60 in contact with the distal faces 66. The rail 60 is preferably longer than the recess 36, with the ends of the rail 60 located under the overhangs 48. The rail 60 may be substantially as long as the distance between the box ends 14. The rail 60 may be attached to the box 12 by strips of adhesive, double-sided adhesive tape or the like, attaching both basal faces 62 to the strips 38, 40 forming the recess 36. Alternatively, the rail 60 may be retained solely by its ends being captive under the overhangs 48. Where the overhangs 48 are used to retain the rail 60, the ends of the rail 60 may be provided with end caps, or may be deformed to fit closely under the overhangs 48 so that the rail 60 does not tip over or move around undesirably in use.

A cutter assembly 70 is positioned within the rail 60. The cutter includes a foot 72 position, a neck 74 extending out through the slot 68, and a head 76 positioned outside the rail 60. Again, the head 76 is preferably positioned inside the effective profile extensions of the box sides 16, 18 above the recess 36. The neck 72 includes a cutter blade or blades. The cutter 70 is arranged to be slid along the slot 68, with the cutter blade(s) facing along the slot. The cutter 70 can be assembled with the rail 60 by inserting the foot 72 into the interior of the rail 60 from one end before the rail is assembled with the box 12, and before any end cap or deformed end is provided. When the container 10 is fully assembled, the foot 72 is captive within the rail 60 in a sufficiently close fit relationship so as to restrain the cutter 70 from tipping or twisting. The cutter blade(s) may be of any form desired. The box ends 14 may extend to the undersides of the overhangs 48, and may provide end stops for the cutter assembly 70. Where the overhangs 48 are not present, the box ends 14 may project outside the strips 38, 40 far enough to provide end stops for the cutter assembly 70. Alternatively, the rail 60 may be deformed at the ends, or provided with separate end stops.

The faces 66 of the rails 60 on which the web material 30 rests for cutting, or the surfaces of the box sides 16, 18 adjacent to the recess 36, may be made of, or coated with, a material that tends to retain the film material 30 weakly, for example, by cling, static cling, or tack. An example of materials for use in retaining film during cutting is described in U.S. patent application Ser. No. 11/071,422, filed Mar. 3, 2005 in the name of Rudolf Pavlik, which is incorporated herein by reference in its entirety.

As may be seen from the drawings and the above description, the cutter assembly 70 is clearly visible on the outside of the box 12, but is entirely within the box profile as defined by the faces 14, 16, 18, 20 and 22. Thus, the container 10 can be shipped and stored with the cutter assembly 70 assembled and installed, but can still be packed, stacked, and displayed efficiently and stably like an ordinary rectangular box.

If the web material is cling wrap or other material that is to be used in contact with food, it may be desired to protect the cutter assembly from potential contamination during shipping and storage. It may also be desired to seal off any openings into the interior of the box 12, such as the slot 28, the openings 50 under the overhangs 48 and the finger holes 52. The entire container 10 may thus be wrapped in any suitable wrapping material, such as, for example, shrink wrap or non-shrink wrap. A guard, such as a rigid portion made of plastic or paperboard, may be provided over the recess 36, and optionally also over the slot 28. Such a guard may be, for example, in the form of an L-shaped strip or in the form of a cap over the entire side 16 and extending down the sides 18 and 22 and the ends 14. Such a guard may be retained in place by an outer wrapping, adhesive tape or the like, or may be attached to the box 12 by a peelable adhesive. A flap may also be formed as part of the lid 16, initially extending over the recess 36 and attached to the box side 18. The end user may then tear off the parts of the flap that cover the recess 36 and the slot 28, and leave a short flap that can be tucked in under a slot in the box side 16 or the like.

In order for the potential purchaser to be able to see that the container 10 has a built-in cutter assembly, it may be preferred for the wrappings and coverings over the recess 36 to be transparent.

In use, any external packaging or wrapping materials are removed. The container 10 may be supplied with a core 32 of web material 30 inside it or, especially if the container 10 is being reused, a separate roll of web material may be supplied by the user. The length of the core 32, and the width of the web material 30, are selected such that the web material will pass through the slot 28, and such that the cutter 70 can travel over the entire width of the web material. The cutter may be arranged to slide into the spaces under the overhangs 48 as far as the insides of the box ends 14, in order to increase the travel of the cutter and thus the width of web material 30 that the container 10 can dispense. The holes 52 are positioned so that the side edges of the web material 30 overlie the holes, and fingers can be inserted in the holes to grasp the edges of the web material.

The cutter 70 is positioned at one end of the rail slot 68, but no other assembling or installation of the cutter assembly by the user is required. The film material 30 is led out of the slot 28 in the box 12 and across the recess 36, and is laid down onto the distal faces 66 of the rail 60. The film material 30 is positioned with a desired length at the free end 34 beyond the slot 68, and laid down onto the box side 18. Then, the cutter 70 is slid across the film material 30 to the other end of the rail 60. The cut length of web material 30 is lifted off the box 12 and removed. When another cut length of the web material 30 is needed, the free end 34 is lifted by a finger in one or each of the holes 52 and moved forward across the rail 60. If the cutter 70 has a cutter blade at only one end, the cutter is returned to the starting position before advancing the web material.

Figure 4:
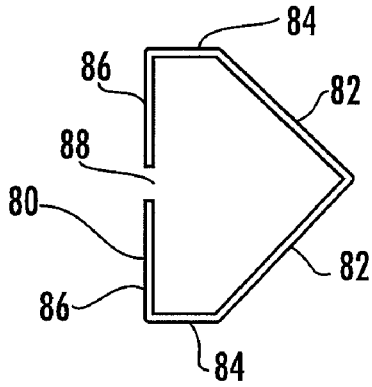
FIG. 4 is a section through an alternative form of cutter rail.

Referring now to FIG. 4, a second form of the rail 80 is generally pentagonal in cross section, with two basal faces 82 approximately at right angles. Two roughly parallel side walls 84 extend from the outer edges of the basal faces. Two roughly coplanar distal faces 86 extend towards each other from the distal edges of the side walls 84 and form between them a slot 88. Unlike the first form of rail 60, the basal faces 82 meet and join together the two sides of the rail 80. A transverse wall 69 is not required, and in the rail shown in FIG. 4 is not present. The second form of rail 80 is dimensioned and positioned similarly to the first form of rail 60.

Figure 5:
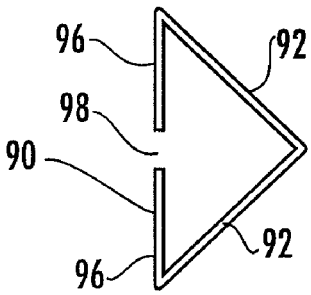
FIG. 5 is a section through a further alternative form of cutter rail.

Referring now to FIG. 5, a third form of the rail 90 is generally triangular in cross section, with two basal faces 92 meeting approximately at right angles. Two roughly coplanar distal faces 96 extend inwards from the distal edges of the basal faces 92, without intervening side walls 64, 84 and form between them a slot 98. The rail 90 is positioned in the recess 36, with the basal faces 92 flat against the strips 38, 40 forming the recess. The rail 90 is so dimensioned that the edges between the basal faces 92 and the distal faces 96 are close to the fold lines 42, 44 at the edges of the recess 36. The foot 72 of the cutter 70 is appropriately shaped to fit into the triangular interior of the rail 90. The container 10 incorporating the third form of rail 90 is otherwise constructed or used in substantially the same way as the container 10 incorporating the first form of rail 60.

Figure 6:
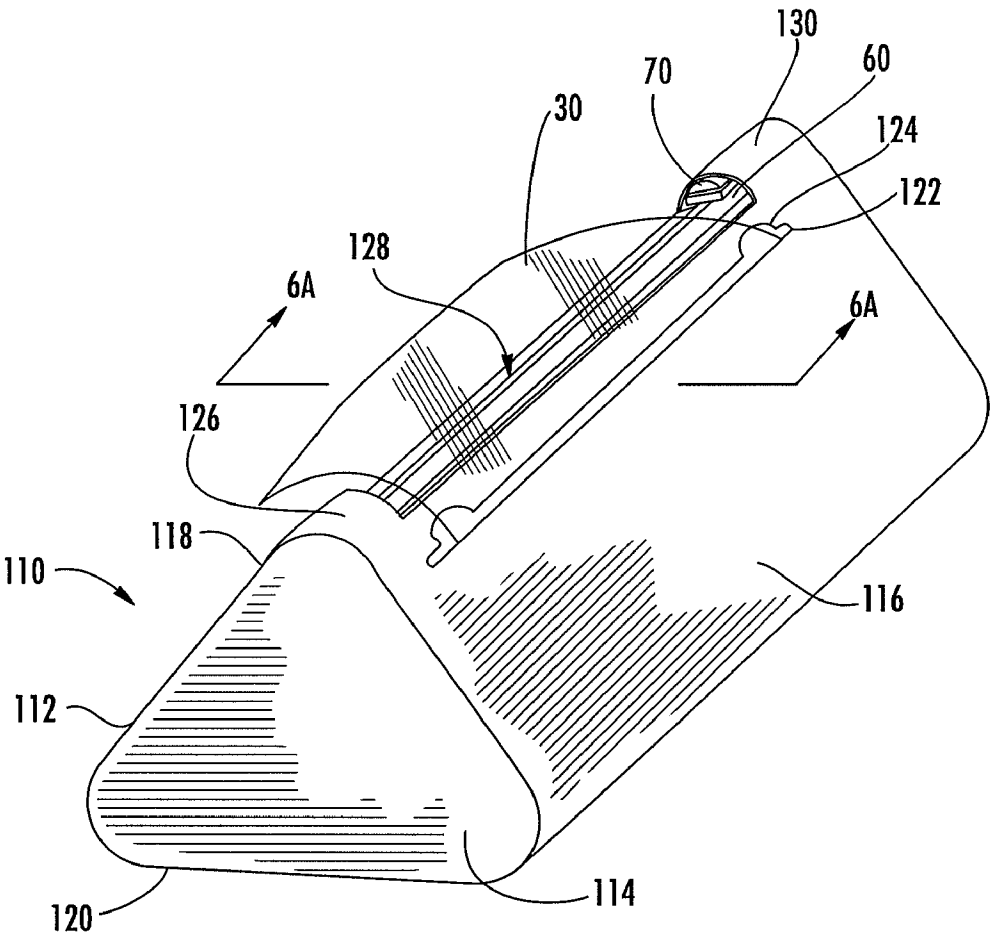
FIG. 6 is a perspective view of a second embodiment of a dispenser as contemplated by the invention.
Figure 6A:
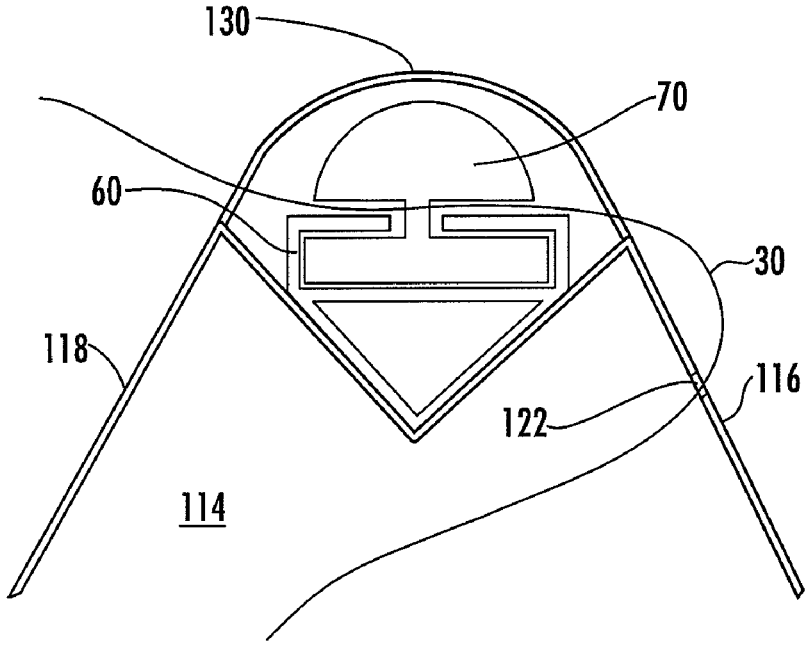
FIG. 6A is a section along the line 6A-6A in FIG. 6.

Referring now to FIGS. 6 and 6A, a second form of container and dispenser for web material, indicated generally the reference numeral 110, comprises a box 112 of generally triangular prismatic shape, with two triangular ends 114, and three sides 116, 118, 120. The edges between the sides 116, 118, 120 as illustrated are rounded. However, a sharp angled transition (such as that illustrated in FIGS. 7 and 8) or some other form may be provided, if so desired. One side 118 has a slot 122 similar to the slot 28 shown in FIG. 1, widened near the ends to form finger holes 124. The edge 126 between the sides 116, 118 is indented to form a recess 128 defined by two flat strips, similar to the recess 36 shown in FIGS. 1 and 2. By selecting the relationship between the width of the recess 128 and the curvature of the edge 126, a desired angle between the two flat strips, for example a recess with the strips at right angles similarly to the strips 42, 44 shown in FIGS. 1 and 2, may be produced.

As shown in FIG. 6, the recess 128 does not extend the full length of the edge 126, and overhangs 130 remain at the ends. A rail 60, 80, 90 is positioned in the recess 128, and a cutter 70 slides in the rail, as described with reference to FIG. 2. The head 74 of the cutter 70 may be differently shaped from that shown in FIG. 2, because of the different constraint of fitting the head 74 within the imaginary continuation of the sides 116, 118 and the curved edge 126. The container 110 shown in FIG. 6 is otherwise similar, and is used similarly, to the container 10 shown in FIGS. 1 to 3. Containers 110 may be stacked and stored as triangular prisms.

Figure 7:
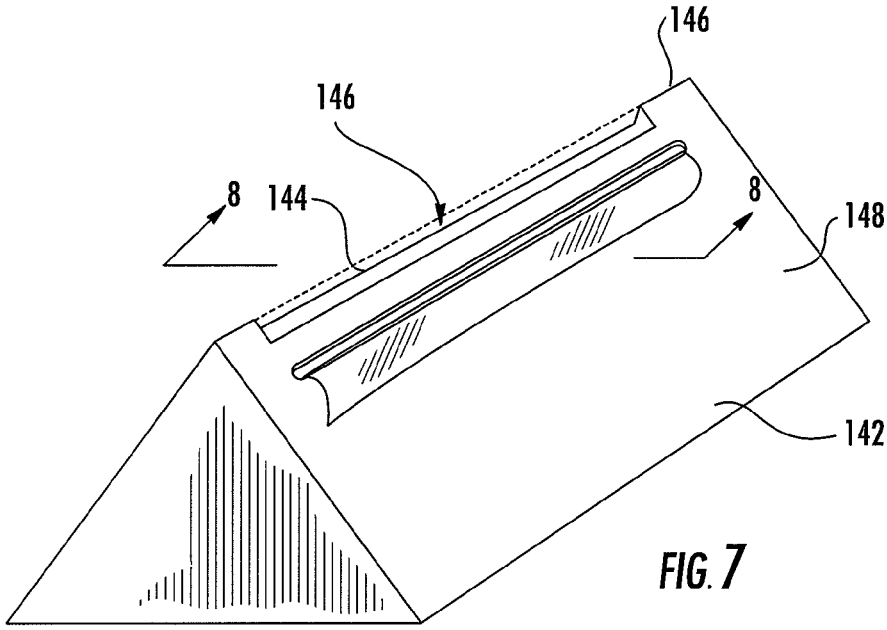
FIG. 7 is a perspective view of a box forming part of a third embodiment of a dispenser as contemplated by the invention.
Figure 8:
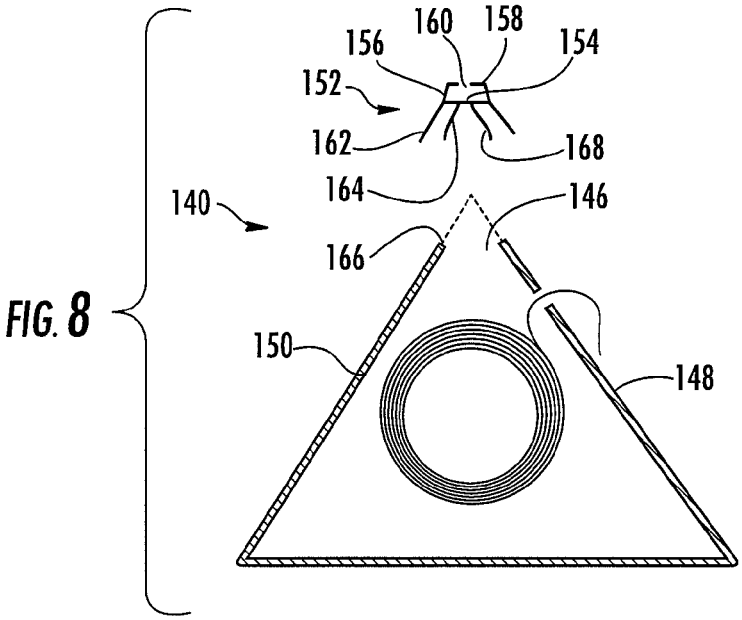
FIG. 8 is a sectional view through the box shown in FIG. 7 and a rail that is combined with the box in forming the third embodiment of a dispenser as contemplated by the invention.
Figure 9:
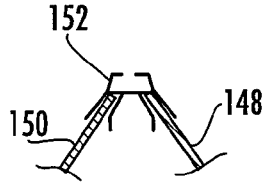
FIG. 9 is a detail sectional view similar to part of FIG. 8 showing the box and rail assembled together.

Referring now to FIG. 7, a further form of container indicated generally by the reference numeral 140 comprises a box 142, which is shown in FIG. 7 as a triangular box, with a cutout 144 along most of the length of an edge 146 between two sides 148, 150. A rail 152 comprises a base 154, two side walls 156 upstanding from either side of the base, and two distal walls 158 extending inwards from the distal edges of the side walls 156 and defining a slot 160. A cutter 70 fits into the rail 152 and projects through the slot 160, as described above with reference to FIGS. 2 and 3. The rail 152 has two pairs of legs 162, 164 extending downwards and outwards from the base 154. Each pair of legs 162, 164 defines a slot into which the edge 166 of one of the box sides 148,150 fits. The inner legs 164 are flexible, and are angled inwards at their free edges 168 so that the free edges fit between the box edges 166.

To assemble the container 140, the rail 152 is pushed onto the box edges 166. The leg free edges 168 fit between the box edges 166, and as the rail is pushed in the inner legs 164 deflect inwards and then snap outwards, holding the rail 152 in place. When the rail 152 is fully in place, the box sides 148, 150 may be gripped between the outer rail legs 162 and the resilient inner legs 164, if the spacing between the legs in their unstressed condition is less than the thickness of the box sides 148, 150. Alternatively, or in addition, the legs 162, 164 may be secured to the box sides 148, 150 by adhesive.

Figure 11:
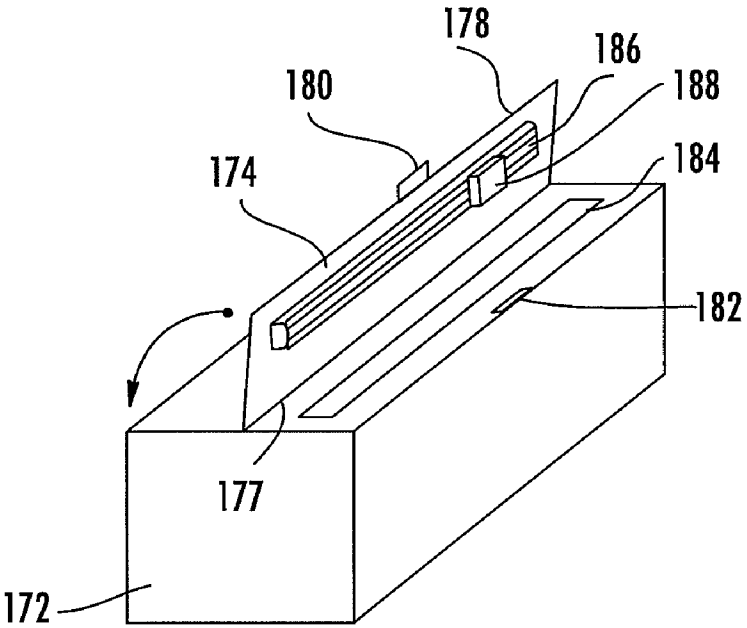
FIG. 11 is a perspective view of the dispenser shown in FIG. 10, in an open condition.
Figure 10:
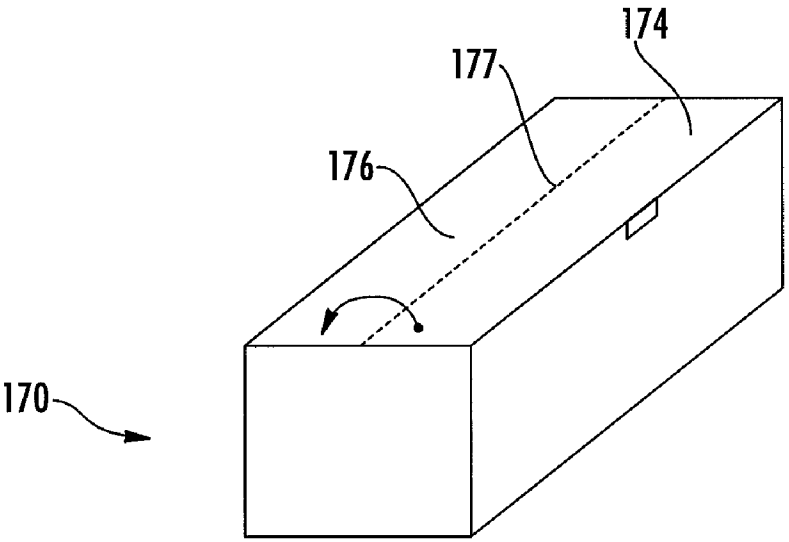
FIG. 10 is a perspective view of a fourth embodiment of a dispenser as contemplated by the invention, in a closed condition.
Figure 12:
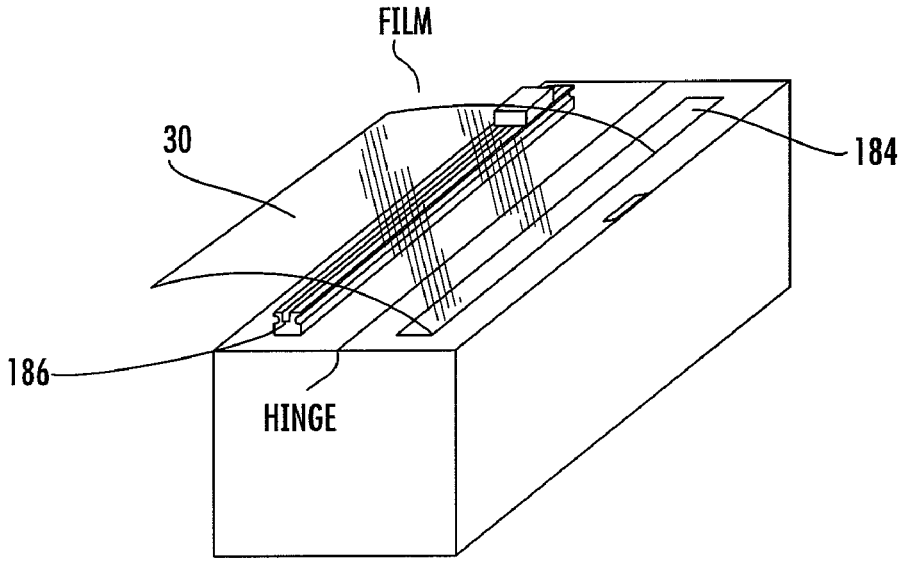
FIG. 12 is a perspective view of a fifth embodiment of a dispenser as contemplated by the invention.

Referring now to FIGS. 10 to 12, a further form of container indicated generally by the reference numeral 170 comprises a box 172 with a lid 174 that overlies approximately half of one side 176 of the box and is hinged at 177 along the midline of the box side 176. The free edge 178 of the lid 174 is provided with a tab 180 that fits into a slit 182 in the edge of the side 176 to locate and secure the lid when the lid is closed. A slot 184, through which web material 30 is led out of the box 172, is formed in the box side 176 under the lid 174. A rail 186 with a cutter 188 is attached to the underside of the lid 174, and is so positioned that when the lid is closed the rail projects through the slot 184 into the interior of the box 172.

The container 172 is shipped and stored with the lid 174 closed, as shown in FIG. 10, and then has a rectangular shape that is easily and efficiently stored, stacked, and displayed. To use the container, the lid 174 is opened, from the condition shown in FIG. 10, in the direction of the arrows in FIGS. 10 and 11, to the open condition shown in FIG. 12. When the lid 174 is open, the lid overlies the other half of the box side 176, with the rail 186 and cutter 188 exposed. As shown in FIG. 12, the web material 30 is then led out of the slot 184 and across the rail 186, where it may be cut off by the cutter 188.

Figure 13:
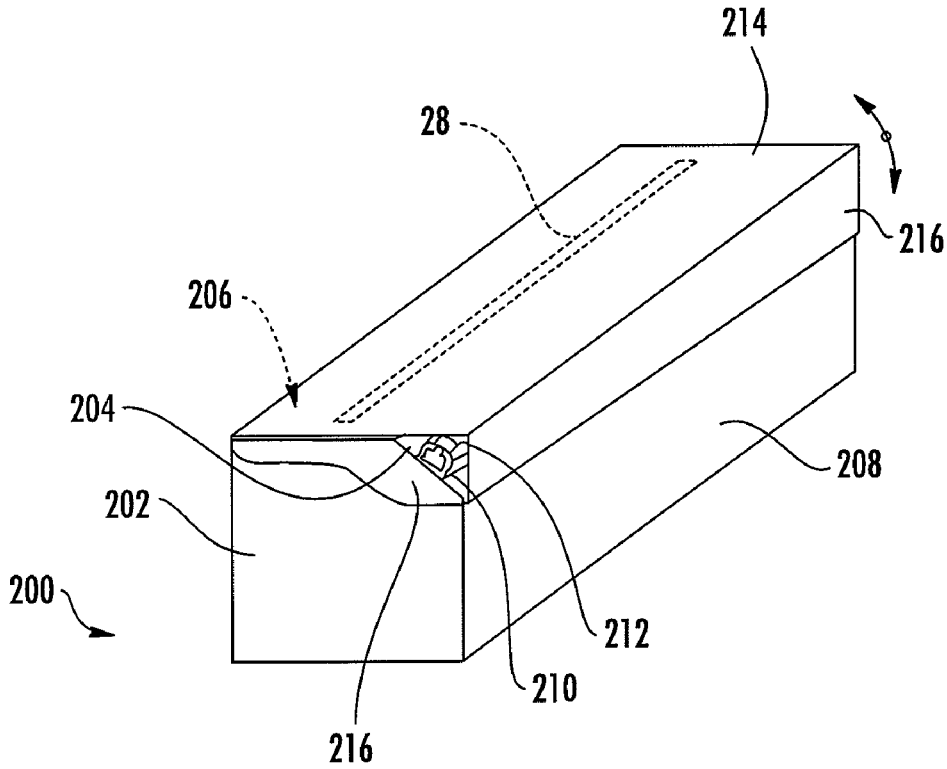
FIG. 13 is a perspective view of another dispenser embodiment of the invention.

Referring now to FIG. 13, a further form of container indicated generally by the reference numeral 200 comprises a generally square or rectangular box 202 formed by a series of four serially connected walls comprising a first wall 206, a second wall (not numbered) connected to the first wall and perpendicular thereto, a third wall (not numbered) connected to the second wall and perpendicular thereto (and therefore parallel to the first wall 206), and a fourth wall 208 connected to the third wall and perpendicular thereto (and therefore perpendicular to the first wall 206). The first wall 206 has a smaller width than the opposite third wall, and the fourth wall 208 has a smaller width than the opposite second wall. The box has an angled corner formed by a sloping wall 204 that extends between one edge of the first wall 206 and an adjacent edge of the fourth wall 208. A rail 210 with a cutter 212 is mounted on the sloping wall 204, inside the imaginary extensions of the walls 206, 208. A slot 28 is formed in the first wall 206. A lid 214 is hinged to the box 202 at the edge of the first wall 206 farther from the sloping wall 204. The lid covers the first wall 206 and has skirts or covers 216 on all sides except the hinge side.

When the lid 214 is closed the skirts 216 overhang the side edges of the box 202 and the top edge of the fourth wall 208, completely enclosing the rail 210 and cutter 212. The lid 214 may be of transparent material, so that the rail and cutter assembly is visible when the lid is closed. When the lid is opened, the slot 28 and the cutter assembly 210, 212 are preferably exposed. Web material may then be fed out of the slot 28 and over the rail 210. Lengths of web material may then be cut off and dispensed as described above.

Figure 15:
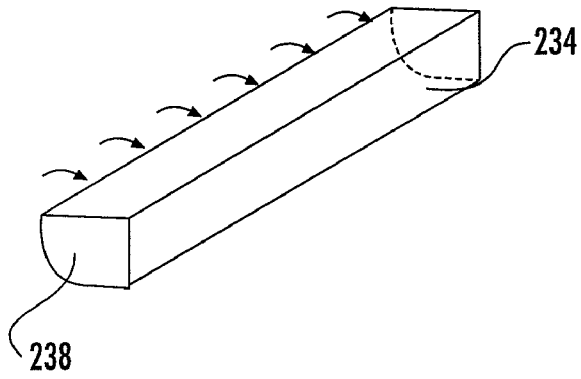
FIG. 15 is a detail view of a lid forming part of the dispenser shown in FIG. 14.
Figure 14:
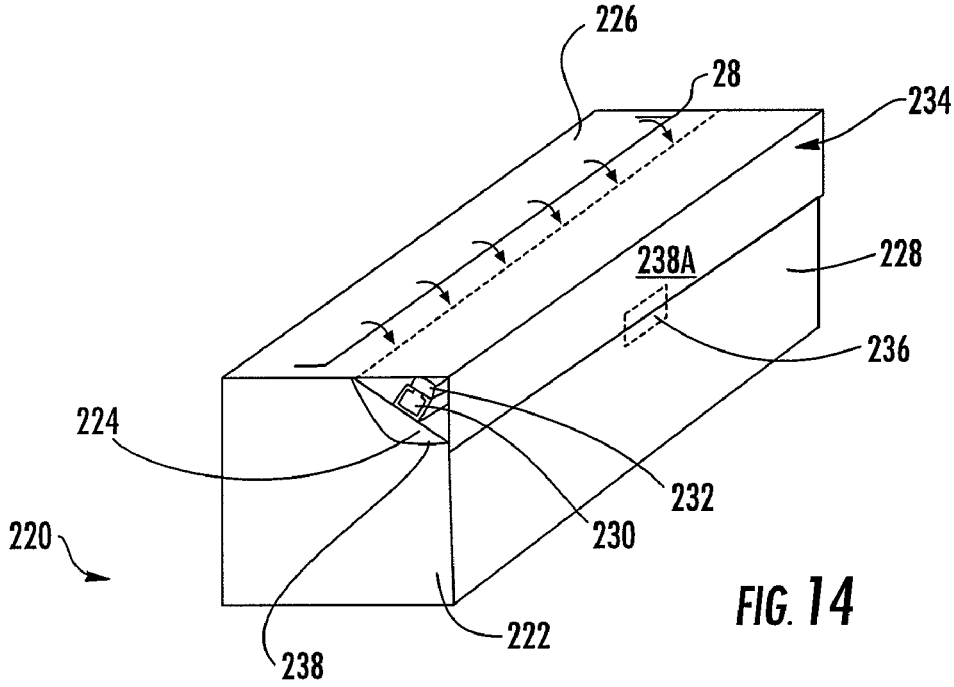
FIG. 14 is a perspective view of a sixth embodiment of a dispenser as contemplated by the invention.

Referring now to FIGS. 14 and 15, a further form of container indicated generally by the reference numeral 220 comprises a box 222 with an angled corner formed by a sloping wall 224 that extends between two adjacent orthogonal sides 226, 228 of the box. A rail 230 with a cutter 232 is mounted on the sloping wall 224, inside the imaginary extensions of the sides 226, 228. As shown in FIG. 14, the sloping wall 224 is angled inwards from the plane of the side 226. A slot 28 is formed in the box side 226. A lid 234 is hinged to the box 222 along the angle where the box side 226 and the sloping wall 224 meet. The free edge of the lid 234 is secured to the box side 228 by a fastener 236, such as adhesive tape 236, hook and loop type fasteners, or the like. The lid has two end skirts extending beyond the sloping wall 224 at the box ends and a front skirt 234A, as best shown in FIG. 15.

When the lid 234 is closed the skirts 238 overhang the ends of the box 222 and the lid is fastened to the box side 228, completely enclosing the cutter assembly 230, 232. The lid 234 may be of transparent material, so that the cutter assembly is visible when the lid is closed. To bring the container 220 into use as a dispenser, the fastener 236 is released, and the lid 234 is opened. The lid 234 is then torn off along the line where the lid joins the box side 236, exposing the rail and cutter assembly 230, 232. Web material may then be fed out of the slot 28 and over the rail 230. Lengths of web material may then be cut off and dispensed as described above.

Figure 16:
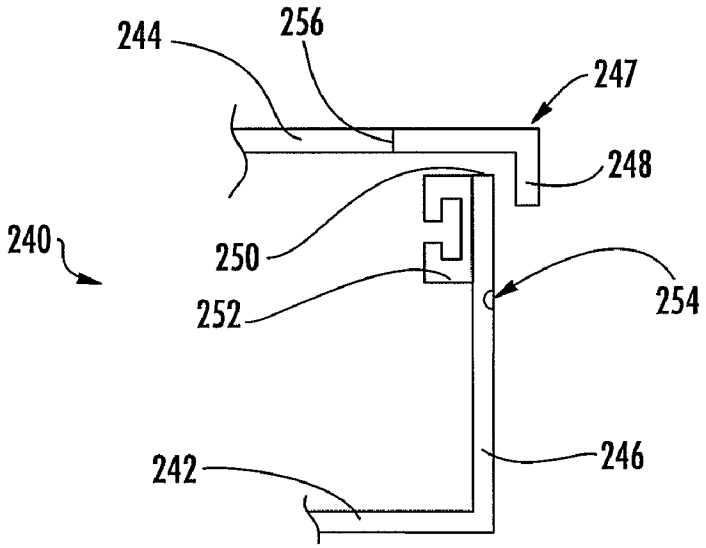
FIG. 16 is a cross section through part of a further embodiment of a dispenser as contemplated by the invention.

Referring now to FIG. 16, a further form of container indicated generally by the reference numeral 240 comprises a box 242 with two adjacent sides 244, 246 that meet at a corner 247. The side 244 has a skirt 248 that extends round the corner and overlies a free edge 250 of the side 246. A rail 252 for a cutter assembly is mounted on the inside (with the box closed) of the side 246 near the free edge 250, with a preformed fold line 254 in the box side 246 on the side of the rail 252 away from the free edge 250. A preformed fold line, tear line, tear strip or the like 256 is formed in the box side 244 near to the corner 247. The free edge 250 of the box side 246 is thus retained under the skirt 248. During shipment of the container, skirt 248 is preferably secured to box side 246, by adhesive or the like.

To open the box, the skirt portion 248 is torn off or folded back at the line 256, releasing the free edge 250 of the box side 246. The box side 246 is then folded back at the fold line 254, so that the part carrying the cutter rail 252 lies flat against the outside of the box 242, with the cutter rail exposed. An adhesive or fastener is preferably provided to secure the free edge 250 to the face of the box side 246. Web material may then be led out of the box 242 through the gap formed between the fold line 254 and the fold or tear line 256, and laid over the cutter rail 252. Lengths of web material may then be cut off by a cutter assembly (not shown) riding in the gap of the rail and dispensed as described above.

Figure 18:
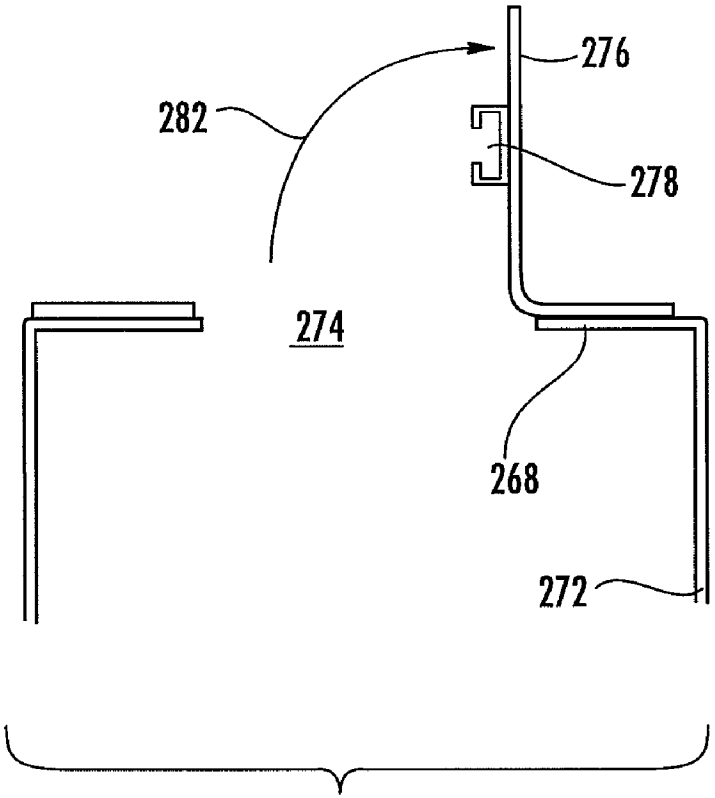
FIG. 18 is a cross section through part of the dispenser shown in FIG. 17, in a partly open condition.
Figure 17:
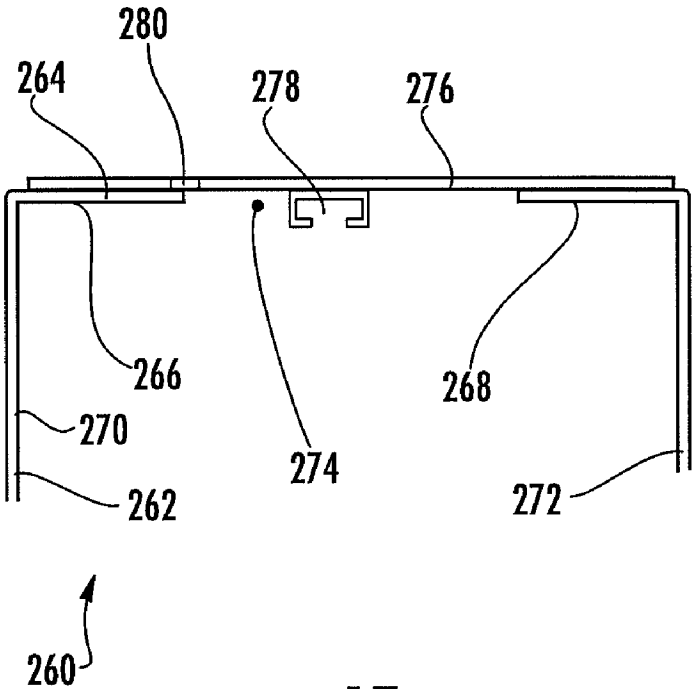
FIG. 17 is a cross section through part of a further embodiment of a dispenser as contemplated by the invention, in a closed condition.

Referring now to FIGS. 17 and 18, a further form of container 260 comprises a box 262, one side 264 of which comprises two flanges 266, 268 extending from the adjacent box sides 270, 272 and defining between them a space 274. An outer panel 276 covers the box side 264 and is bonded to the flanges 266, 268. The middle of the outer panel 276 has a cutter rail 278 attached to its inner side where the panel spans the space 274. The outer panel 276 is provided with a tear strip 280 near to the free edge of one flange 266. The outer panel 276 may be formed with a fold line near to the free edge of the other flange 268. Alternatively, the edge between the unsupported outer panel 276 and the outer panel bonded to the flange 268 may provide a sufficiently definite fold line.

To open the box 262, the middle of the outer panel 276 is separated from the flange 266 by use of the tear strip 280, and the unsupported middle of the outer panel is folded back at the free edge of the flange 268 as shown by the arrow 282 in FIG. 18, until the cutter rail 278 lies, facing outwards, on the flange 268 or the box side 272. Web material from inside the box 262 may then be led out through the space 274 and laid over the cutter rail 278.

Figure 19:
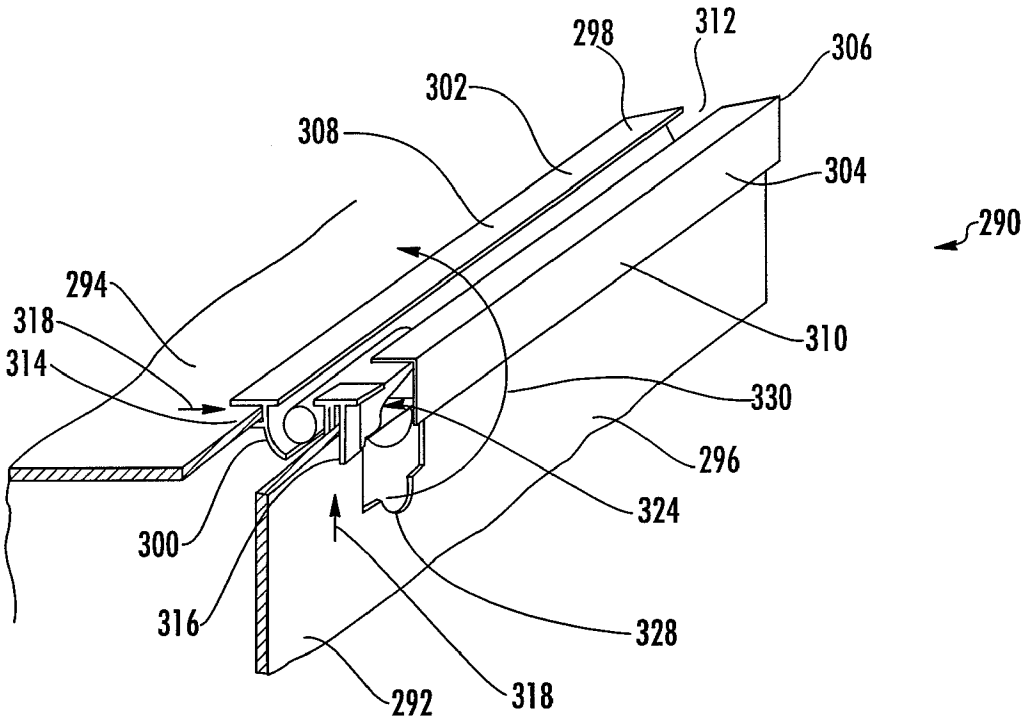
FIG. 19 is a partly exploded fragmentary perspective view of a further embodiment of a dispenser as contemplated by the invention.
Figure 20:
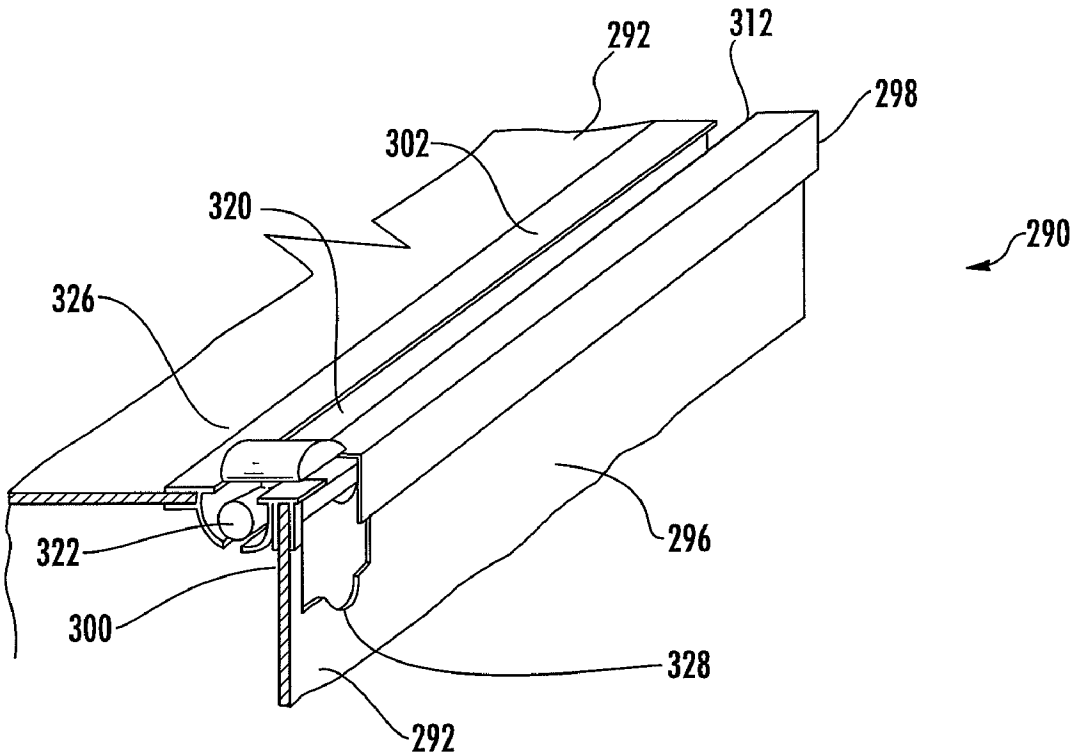
FIG. 20 is a fragmentary perspective view of the dispenser shown in FIG. 19, in an alternative condition.

Referring now to FIGS. 19 and 20, a further form of container 290 comprises a box 292 with adjacent sides 294, 296. The box sides 294, 296 do not meet. A cutter rail 298 occupies the corner between the box sides 294, 296. The cutter rail 298 comprises a generally tubular guide 300. Part of the guide 300 is preferably of rectangular section, with two flat faces 302, 304 forming a corner 306 of the box 292. The flat faces 302, 304 are extended as outer flanges 308, 310 overlying the box sides 294, 296 on the outside of the box 292. A slot 312 extending along the length of the tubular guide 300 opens through one of the flat faces 302. Inner flanges 314, 316 extend from the tubular guide 300 overlying the box sides 294, 296 on the inside of the box 292. Free edges of the box sides 294, 296 are inserted between the outer and inner flanges 308, 314 and 310, 316 as shown by the arrows in FIG. 19, and secured by adhesive. Alternatively, the box sides 294, 296 may be interference fits between the outer and inner flanges 308, 314 and 310, 316.

A cutter 320 comprises a foot 322 that is captive in the tubular guide 300, a neck 324 that in an operating position of the cutter assembly as shown in FIG. 20 extends through the slot 312, and a handle or head 326 that in the operating position overlies the flat face 302 of the rail 298. The foot 322 is roughly cylindrical, so that it can rotate about the longitudinal axis of the tubular guide 300 as explained below. A cutter blade is provided on the neck 324 for cutting web material 30 laid over the rail 298. Near one end of the rail 298, a cutout 328 is provided in the box side 326, in the flat face 304 of the rail 298, in the part of the flat face 302 between the corner 306 and the slot 312, and in the side of the tubular guide 300 facing the flat face 304. As shown in FIGS. 19 and 20, the cutout 328 is as long in the lengthwise direction of the rail 298 as is the head 326 of the cutter 320. The foot 322 of the cutter 320 is longer than the cutout 328.

When the cutter 320 is slid to a position level with the cutout 328, the cutter can be rotated about the longitudinal axis of the tubular guide 300, with the head and neck of the cutter swinging sideways into the cutout 328. The cutter 320 can rotate into a non-use position, as shown in FIG. 19, in which the neck 324 and head 326 are approximately on the opposite side of the tubular guide 300 from the slot 312. The cutout 328 does not extend round the back of the tubular guide 300, and the non-use position of the cutter 320 is determined by the neck 324 of the cutter abutting the back of the cutout in the tubular guide. The width of the head 326 of the cutter 320 is selected so that in the non-use position the head is approximately flush with or slightly recessed behind the outer surface of the box side 296, but is not behind the inner flange 316. The inner flange 316 then prevents the cutter 320 from moving axially out of alignment with the cutout 328 when the cutter is in the non-use position. Alternatively, the part of the cutout 328 in the tubular guide 300 within which the neck 324 of the cutter 320 rests in the non-use position may be only as long as the neck 324, or another baffle may be provided to prevent the cutter moving axially behind the box side 296 in the non-use position. The part of the cutout 328 in the box side 296 extends away from the corner 306 further than the head 326 of the cutter 320, enabling a user's finger to be inserted.

For shipping and storage, the cutter 320 is placed in the non-use position within the cutout 328. The container 290 then has a substantially rectangular profile, with the faces 302, 304 of the rail 298 projecting only slightly above the box sides 294, 296. The slot 312 and the cutout 328 may be covered by a lid, wrapping, or other cover as discussed above. To use the container 290, the user removes any cover, inserts a finger into the cutout 328, and swings the head 326 of the cutter 320 out in the direction of the arrow 330 in FIG. 19 into the operating position shown in FIG. 20, in which the cutter can be slid along the slot 312. Web material is then led out of the interior of the box 292 through a slot (not shown in FIGS. 19 and 20) and laid on the flat face 302 across the rail slot 312. A desired length of web material is then cut off by sliding the cutter along the rail 298 as described above. For subsequent storage, the cutter 320 may be either returned to the non-use position or left in the operating position at one end of the rail slot 312.

Figure 22:
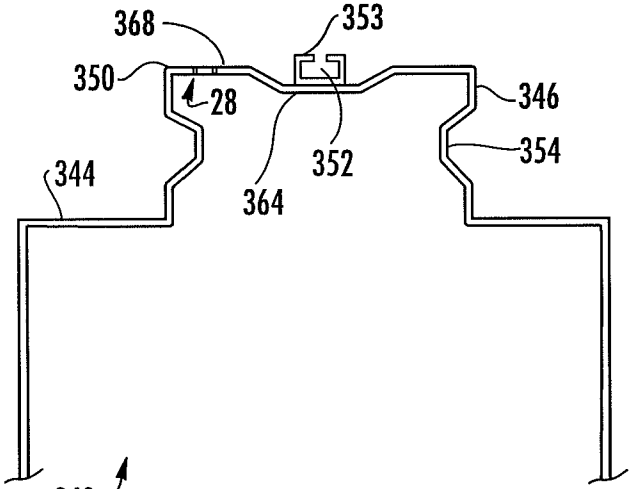
FIG. 22 is a cross section through part of the dispenser shown in FIG. 21, in a condition for use.
Figure 21:
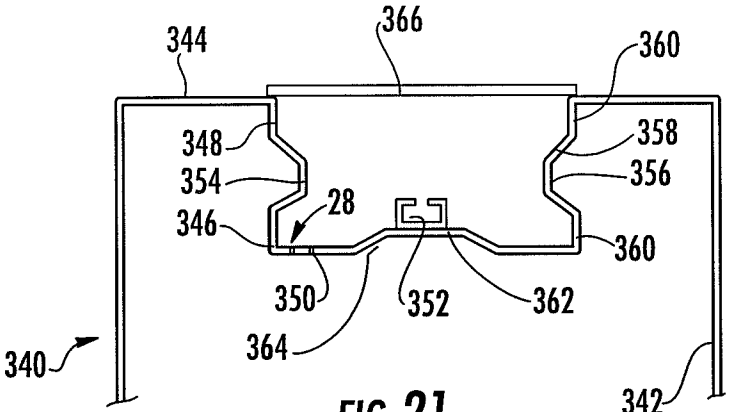
FIG. 21 is a cross section through part of a further embodiment of a dispenser as contemplated by the invention, in a condition for storage.

Referring now to FIGS. 21 and 22, a further form of container indicated generally by the reference numeral 340 comprises a box 342, one side 344 of which has, in a non-use condition as shown in FIG. 21, a recessed channel 346. The channel 346 is generally rectangular in section, with two side walls 348 and a bottom wall 350. A cutter rail 352 is mounted on the bottom wall 350 of the channel 346. Each of the side walls 348 has a trapezoidal fluted section 354 formed by a mid-facet 356, generally parallel to but offset from the main plane of the side wall 348, and two oblique facets 358 joining the edges of the mid-facet 356 to facets 360 of the side wall in the main plane on either side of the fluted section. The angles between the various facets are creased sharply enough that under an applied force the side walls 348 tend to flex at the creases without crumpling or bending the facets. The cutter rail 352 is mounted on the mid facet 362 of a fluted section 364 formed in the bottom wall 350.

In the non-use condition shown in FIG. 21, for shipping, storage, and display, the channel 346 is inside the outline of the box as defined in part by the plane of the box wall 344, and all of the fluted sections 354, 364 project into the interior of the channel 346. As may be seen from FIG. 21, the underside of the flute 364 renders the bottom wall 350 of the channel 346 concave towards the middle of the box 342, increasing the space available for a core 32 of web material 30 in the box 342. The channel 346 is covered by a strip of material 366 that is bonded to the box side 344 on either side of the channel with peelable adhesive. The container 340 is thus substantially rectangular in shape.

For use, the user removes the covering strip 366, reaches into the channel 346, grasps the cutter rail 352, and pulls. Alternatively, if the box 342 can be opened, the user may push from the other side of the bottom wall 350. The flexibility provided by the fluted sections 354 allows the entire channel 346 to be inverted so that the channel projects outward from the box wall 344, with the cutter rail 352 on top of the channel. As shown in FIG. 22, the flute 364 is separately inverted, so that the flute 364 is concave outward, with the cutter rail 352 in the concavity. The upper surfaces 353 of the cutter rail 352 are then closer to the plane of the outer facets 368 of the channel bottom wall 350, allowing web material 30 to be laid smoothly over the channel bottom wall and the cutter rail for cutting. The bottom wall 350 of the channel 346 defines a slot 28 through which the web material 30 is led out from the container.

As illustrated in FIGS. 21 and 22, there is a number of surface elements designed to create flexibility in the channel 346. Other configurations are contemplated to create this function for the wall construction, such as accordion style bellows, etc.

Figure 24:
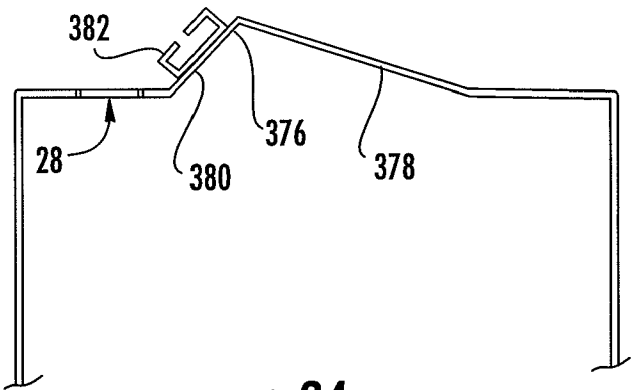
FIG. 24 is a cross section through part of the dispenser shown in FIG. 23, in a condition for use.
Figure 23:
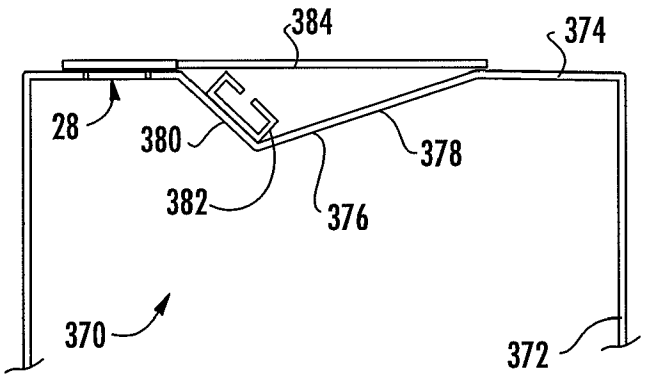
FIG. 23 is a cross section through part of a further embodiment of a dispenser as contemplated by the invention, in a non-use condition.

Referring now to FIGS. 23 and 24, a further form of container indicated generally by the reference numeral 370 comprises a box 372, one side 374 of which has, in a non-use condition as shown in FIG. 23, a recessed channel 376. The channel 376 is generally triangular in section, with two side walls 378, 380. A cutter rail 382 is mounted on one of the side walls 380 of the channel 376. The cutter rail is positioned and dimensioned so that it does not project above the plane of the box side 374.

In the non-use condition shown in FIG. 23, for shipping, storage, and display, the channel 376 is covered by a strip of material 384 that is bonded to the box side 374 on either side of the channel with peelable adhesive. The container 370 is thus substantially rectangular in shape.

For use, the user peels off the cover strip 384, and then inverts the channel 376 to the position shown in FIG. 24, projecting outward from the box side 374, with the cutter rail 382 on the outside. Because of the triangular shape of the channel 376, inverting the channel typically involves spreading the outer facets of the box side 374 apart, or bending one or more of the facets of the channel 376. The required flexibility is taken into consideration in determining the materials and construction for the box 372.

Figure 26:
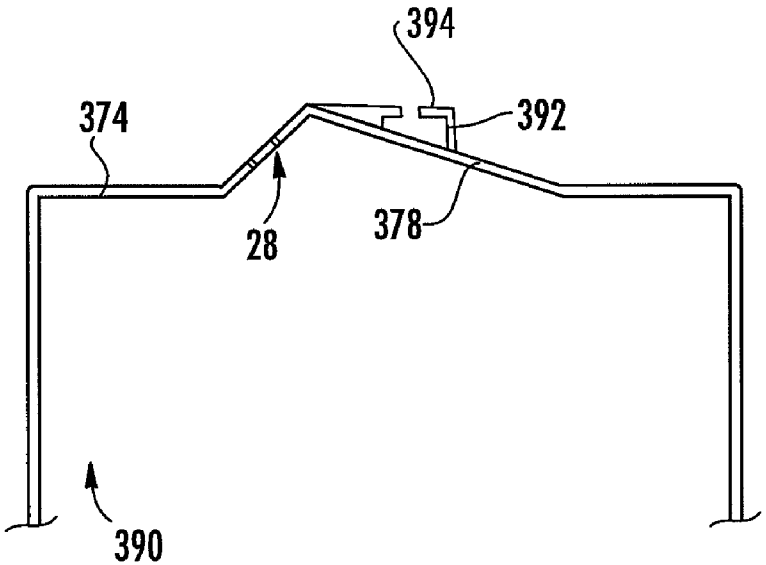
FIG. 26 is a cross section through part of the dispenser shown in FIG. 25, in a condition for use.
Figure 25:
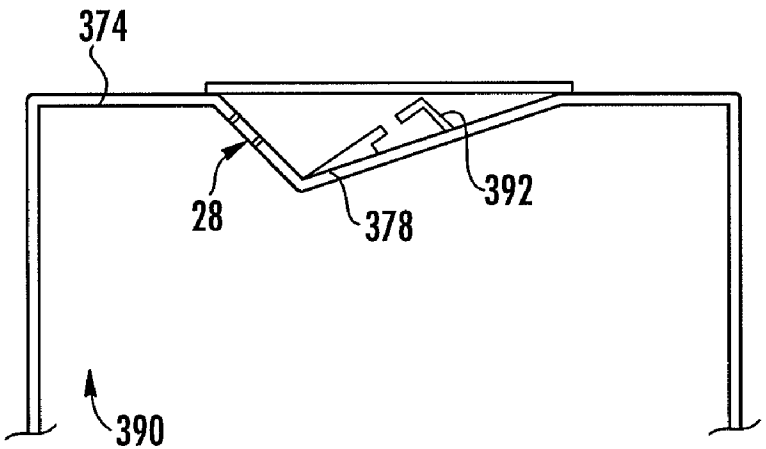
FIG. 25 is a cross section through part of a further embodiment of a dispenser as contemplated by the invention, in a condition for storage.

Referring now to FIGS. 25 and 26, a further form of container 390 is generally similar to the container 370 shown in FIGS. 23 and 24. Reference is made to the description of FIGS. 23 and 24, which will not be unnecessarily repeated. Like reference numerals are used for like elements in both forms of container 370 and 390. However, the cutter rail 382 shown in FIGS. 23 and 24 is generally rectangular in cross section, so that the distal surface on which the web material is laid for cutting is parallel to the box facet 380 to which the rail is attached. As may be seen from FIG. 24, this may result in the cutter being positioned in use at an angle that is awkward for the user, or does not assist laying the web material smoothly over the cutter rail 382 for cutting. In FIGS. 25 and 26, the cutter rail 392 is wedge-shaped in cross section, so that in the operating position shown in FIG. 26 the cutting surface 394 of the cutter rail is roughly parallel to the plane of the box side 374.

In FIGS. 23 through 26, the channel 374 is shown with sides 378, 380 of different lengths, and thus at different angles to the plane of the box side 374. The cutter rail 382 in FIGS. 23 and 24 is shown mounted on the shorter, steeper, channel side 380. The cutter rail 392 in FIGS. 25 and 26 is shown mounted on the longer, more gently sloped, channel side 378.

Either cutter rail may be mounted on either slope, with appropriate adjustment to the shape of the cutter rail 392 for the angle of the slope on which it is mounted, and with appropriate selection of the position of the cutter rail so as not to project through the cover strip 384 in the non-use condition.

Figure 27:
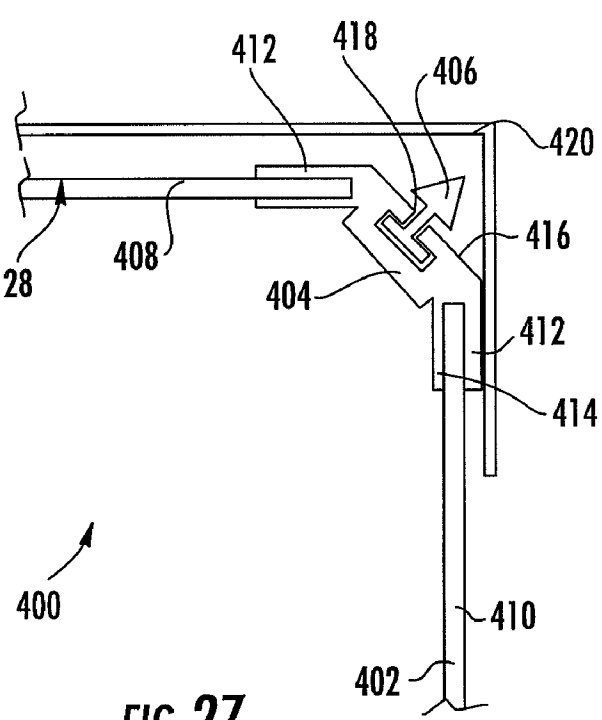
FIG. 27 is a cross section through part of a further embodiment of a dispenser as contemplated by the invention.

Referring now to FIG. 27, a further form of container, indicated generally by the reference numeral 400, comprises a box 402 with a cutter assembly, comprising a cutter rail 404 and a cutter 406, at a corner between adjacent sides 408, 410. The cutter rail 404 has outer flanges 412 and inner flanges 414 holding between them free edges of the box sides 408, 410. The cutter rail 404 may be fastened to the box edges by adhesive, or may be an interference fit. The cutter rail 404 has an angled corner 416, in which is a slot 418 in which the cutter 406 runs. The cutter has a head 420 projecting from the rail slot 418. The head 420 is dimensioned so that it does not project beyond the imaginary continuations of the outer surfaces of the box sides 408, 410. The container 400 has a lid 422 that covers the box side 408, including a slot 28 for web material 30. The lid 422 has skirts 424 that extend down over the cutter rail 404. The lid may be of transparent material so that, when the container 400 is displayed in a store, the cutter assembly 404, 406 and printed material on the box side 408 are visible to potential purchasers.

Figure 28:
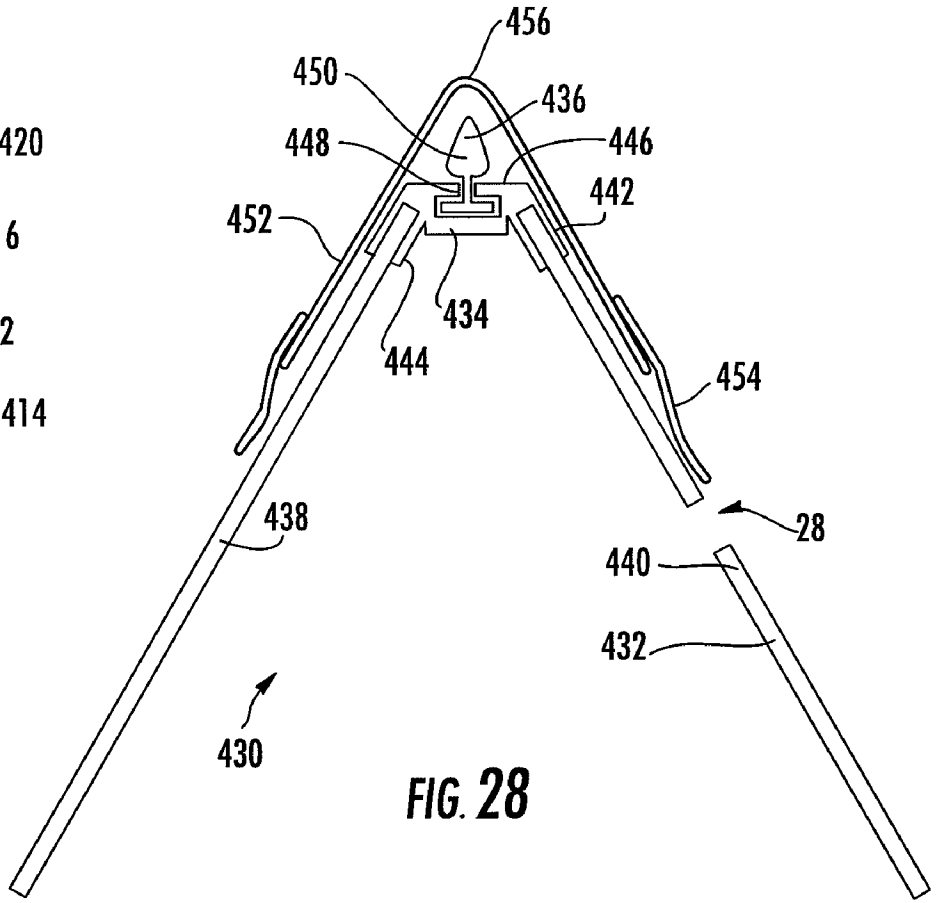
FIG. 28 is a cross section through part of a further embodiment of a dispenser as contemplated by the invention.

Referring now to FIG. 28, a further form of container, indicated generally by the reference numeral 430, comprises a triangular box 432 with a cutter assembly, comprising a cutter rail 434 and a cutter 436, at a corner between adjacent sides 438, 440. The cutter rail 434 has outer flanges 442 and inner flanges 444 holding between them free edges of the box sides 438, 440. The cutter rail 434 may be fastened to the box edges by adhesive, or may be an interference fit. The cutter rail 434 has an angled corner 446, in which is a slot 448 in which the cutter 436 runs. The cutter has a head 450 projecting from the rail slot 448. The head 450 is dimensioned so that it does not project beyond the imaginary continuations of the outer surfaces of the box sides 438, 440. If the box 432 has rounded corners, the cutter head 450 may be dimensioned so that it does not project beyond the curve of the rounded corner. The container 430 has a cover 452 that fits over the cutter assembly 434, 436 and is fastened to the box sides 438, 440 by adhesive tape 454. The cover 452 has a rounded corner 456 that matches the curvature of the other corners of the box 432. The cover 452 may be of transparent material so that, when the container 430 is displayed in a store, the cutter assembly 434, 436 is visible to potential purchasers. A slot 28 for the web material is provided in the side wall 440 adjacent the cutter assembly.

Figure 29:
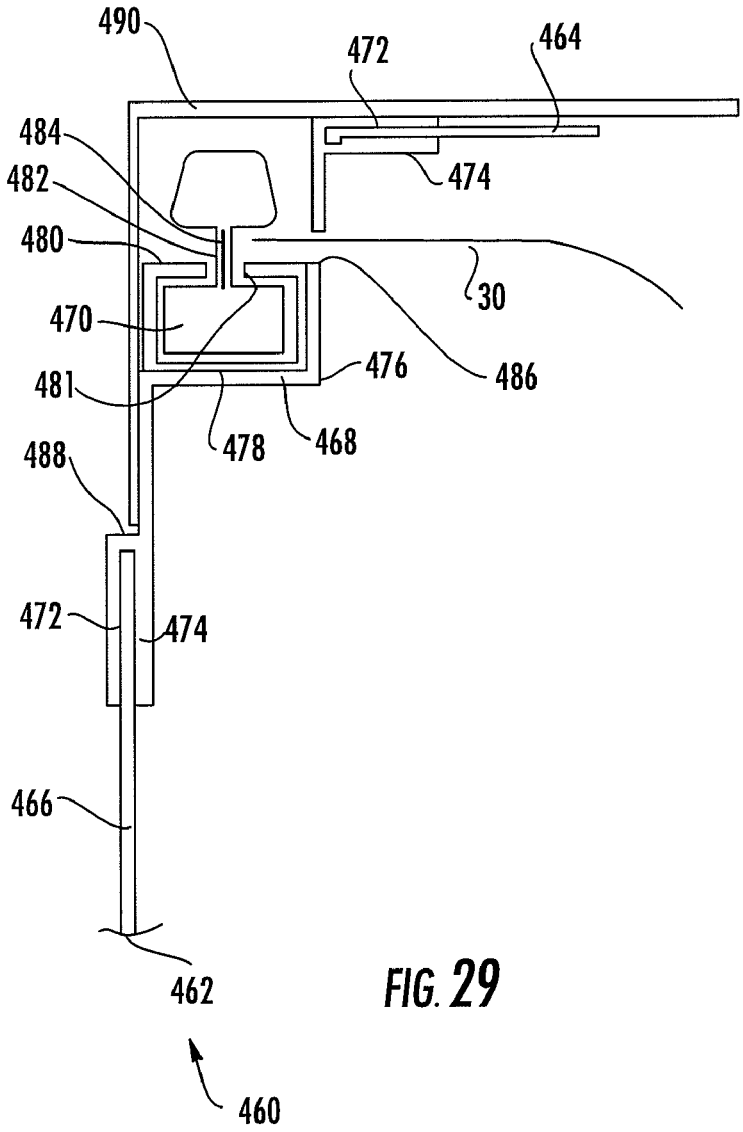
FIG. 29 is a cross section through part of a further embodiment of a dispenser as contemplated by the invention.

Referring now to FIG. 29, a further form of container, indicated generally by the reference numeral 460, comprises a box 462 with adjacent sides 464, 466. A cutter assembly comprising a cutter rail 468 and a cutter 470 is mounted in the corner between the adjacent sides 464, 466. The cutter rail 468 has outer flanges 472 and inner flanges 474 that receive between them the free edges of the adjacent sides 464, 466. The cutter rail 468 comprises a recess 476, within which are a cutter guide 478 and the cutter 470. The cutter guide 478 has a surface 480 with a slot 481 in the surface. A neck 482 of the cutter 470, carrying a cutter blade 484, projects from the rail slot 481 to cut web material 30 that is laid across the surface 480. A slot 486 is formed in the extension of the rail 468, between the cutter guide 478 and the flanges 472, 474 that receive the box side 464. The slot 486 is positioned so that web material 30 can be led from inside the box 462 out of the slot 486 and across the surface 480 of the cutter guide 478. At one side of the cutter rail 468, the outer flange 472 is offset outwards from an adjacent part of the cutter rail, forming a step 488. An edge of a lid or cover 490 seats in the step 488. A similar step may be formed at the other side of the cutter rail, and the cover 490 seated in both steps. Alternatively, the other side of the cover 490 may be attached to the box 462 in another way.

Figure 30:
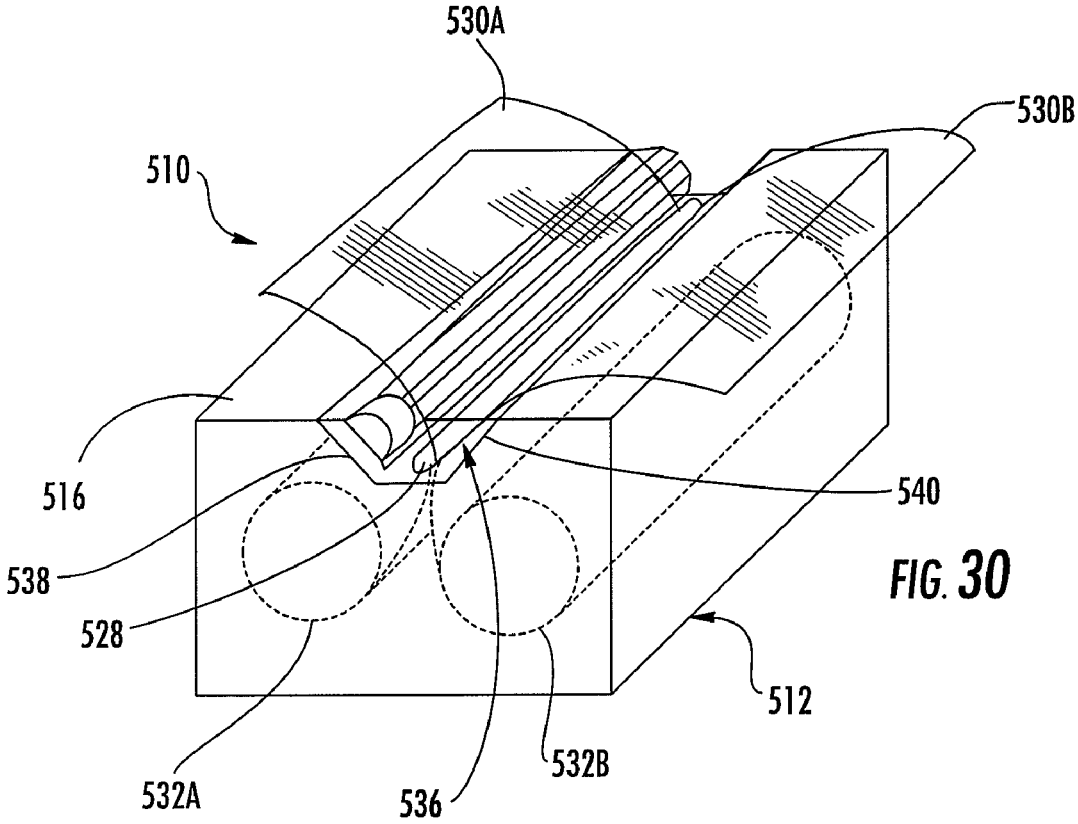
FIG. 30 is a perspective view of a still further embodiment of a dispenser as contemplated by the invention.
Figure 31:
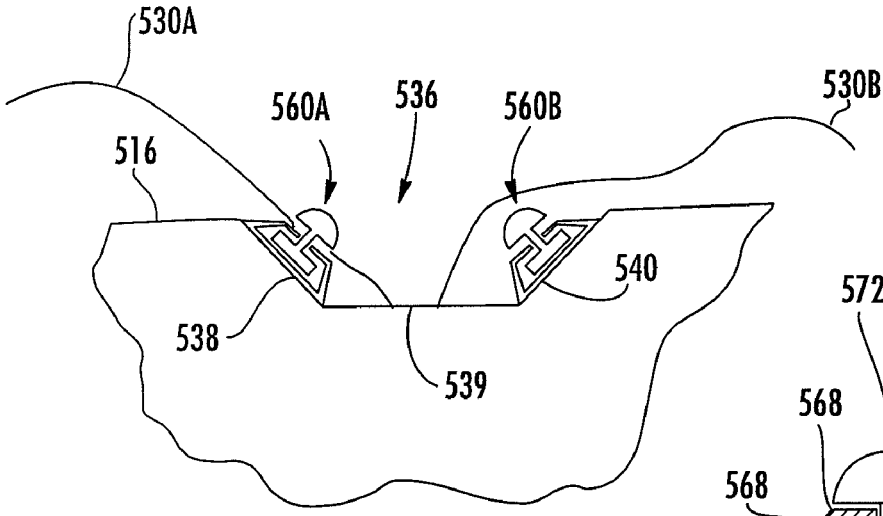
FIG. 31 is an enlarged, partial cross section through part of the embodiment of a dispenser as shown in FIG. 30.
Figure 32:
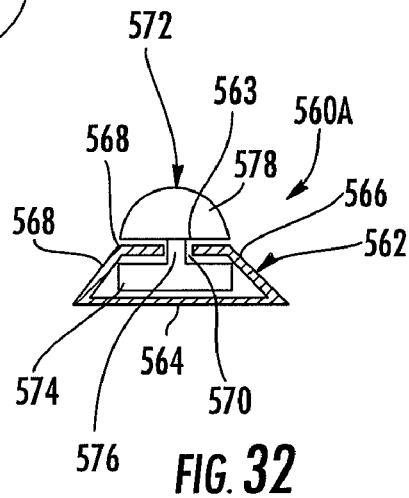
FIG. 32 is a partial cross section view of the track portion of the dispenser shown in FIGS. 30 and 31.

Referring to FIGS. 30-32, a further form of container 510 is illustrated comprising a box 512 having a generally elongated rectangular configuration with a central recess 536 in the top surface 516. The recess 536 is defined by two angled strips 538, 540 and a trough 539; the trough 539 has one or more slots 528 therein. The box 512 contains two separate rolls 532A, 532B of web material 530A, 530B. It is contemplated that the two rolls will be distinct materials, such as, e.g., plastic wrap and aluminum foil. As illustrated in FIG. 31, two separate cutter assemblies 560A, 560B are provided within the recess 536 in the box top 516. The distinct web materials 530A, 530B extend out of the slot 528 and across a corresponding cutter 560A, 560B.

Each cutter assembly 560A, 560B as illustrated is in the form shown in FIG. 32. The rail portion 562 includes a base 564, two angled side portions 566 and a top 568, defining a slot 570. A sliding cutter 572 is provided and includes a flat portion 574, a neck portion 576 supporting one or more cutter blades, and an actuation head 578, similar to those items found in the cutter assemblies of the above discussed embodiments.

The form of the central recess as illustrated includes angled walls. However, the recess may include 90° walls, such as that contemplated by the embodiment of FIG. 1. A corresponding adjustment of the cutter assembly may be desired, incorporating, e.g., the rail profiles of FIGS. 3-5. Adjustment of the form of the box to create the varying forms for the recess are contemplated to be within the skill of the art.

One reason for the provision of the two cutter assemblies relates to the two distinct material rolls. If, e.g., a plastic or cling wrap is provided on roll 532A, certain cling, static cling or tack construction may be desirable on the edges of the track to hold the material in place during cutting. However, if aluminum foil, e.g., is provided on the alternate roll 532B, the rail properties may be required to be different or a different cutter assembly may be desirable.

Further variations of the container 510 may be desired to meet the needs of the user. One example is the provision of a flap or cover that protects the cutter assemblies as is discussed above.

Figure 33:
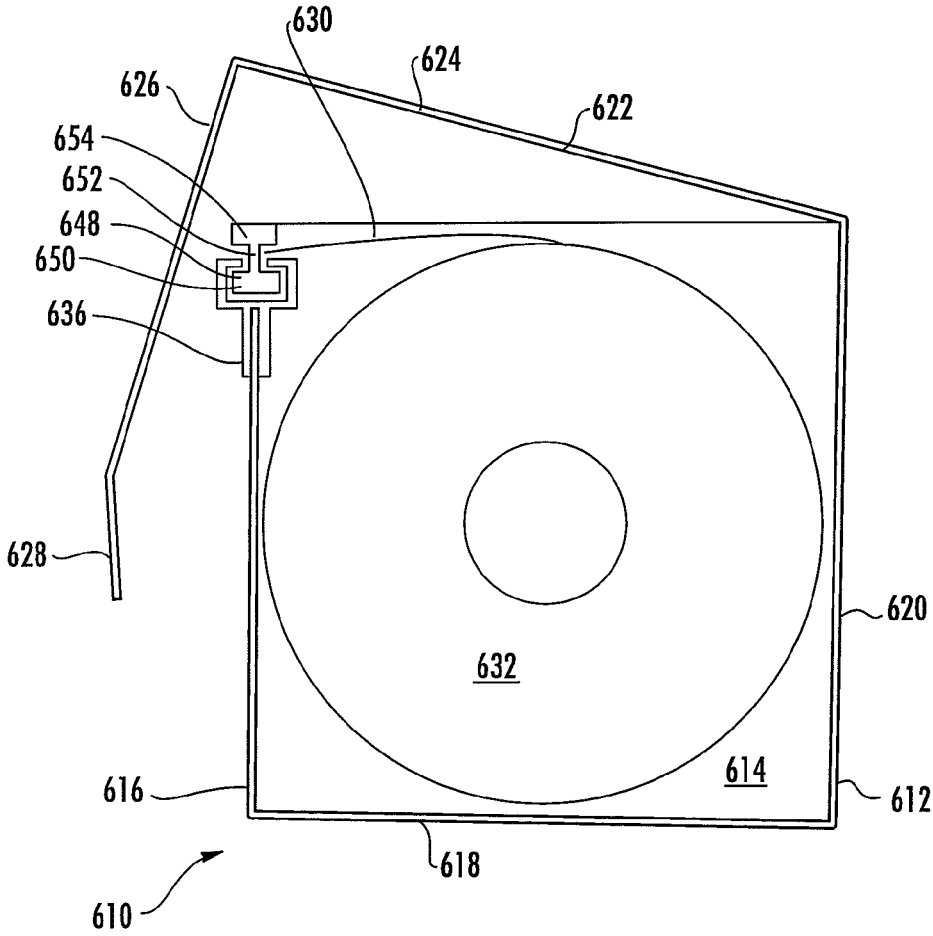
FIG. 33 is a cross section view of a still further embodiment of a dispenser as contemplated by the invention.
Figure 34:
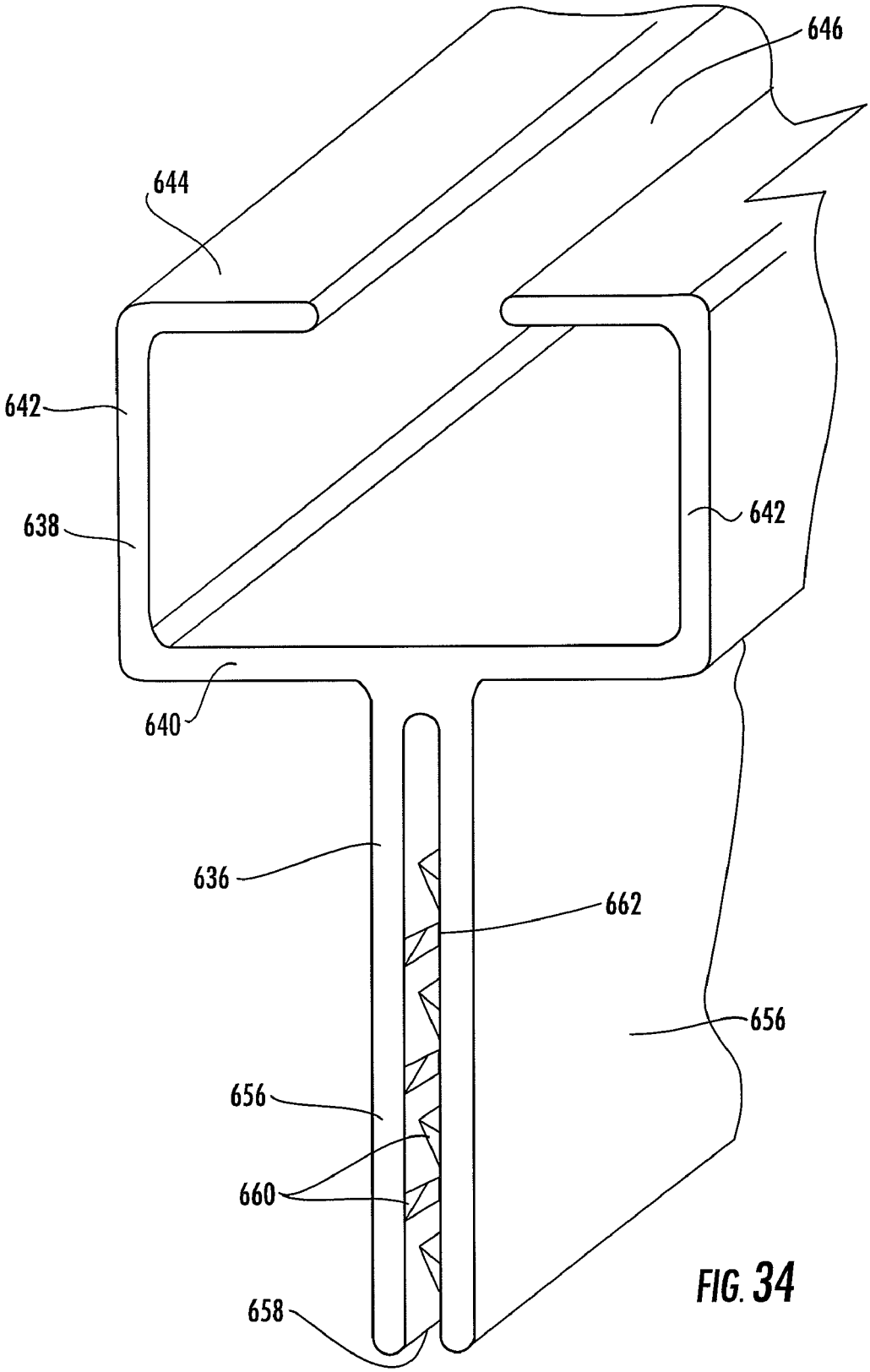
FIG. 34 is a perspective view of a cutter rail of the dispenser shown in FIG. 33.

Referring now to FIGS. 33 and 34, a further form of container 610 is shown in cross section. The container comprises a box 612 having end walls 614 (only the far end wall shown in FIG. 33), a front wall 616, a bottom wall 618, a back wall 620 and a lid 622. Each of the walls is positioned orthogonal to an adjacent wall and together generally define an interior space. The lid portion 622 comprises a top wall 624, a flap 626 and a tab 628. Web material 630 is preferably stored in a roll 632 and positioned within the inside space defined by the walls of the box 612. The lid 622 is hingedly secured to the top edge of the back wall 620. When the lid 622 is closed, the top wall 624 covers the upper portions of the box 612 between the back wall 620 and the front wall 616. The flap 626 overlies the front wall 616, with the tab 628 overlying a lower part of the front wall.

A cutter rail 636 extends substantially the length of the box 612. As shown in FIG. 34, the cutter rail 636 comprises a rail portion in the form of a channel 638 of generally rectangular cross section. The rail channel includes a base 640, two side walls 642 and a top 644, defining a slot 646. A sliding cutter 648 (see FIG. 33) is provided inside the channel 638 and includes a foot 650 (captive inside the channel 638), a neck portion 652 supporting one or more cutter blades and extending through the slot 646, and an actuation head 654. The sliding cutter is contemplated to be similar in form to those cutter assemblies discussed above.

Two fins 656 project from the base 640 of the rail portion 638, opposite the slot 646. The fins 656 may extend the length of the rail 638, or may be shorter at the ends. The fins 656 may also have gaps along the length of the rail. The fins are parallel to one another and are spaced to define a gap 658. As illustrated, ribs 660 project from the fins 656 into the gap 658. The ribs 660 extend along the length of the fins and are preferably triangular in cross-section. The ribs 660 may have any asymmetrically shape and their projecting tips 662 preferably are angled towards the upper portion of the rail. As shown in FIG. 34, there are several ribs 660 on each of the fins 656, and the ribs alternate within the gap 658. The width of the gap 658 and the dimension and stiffness of the ribs 660 are chosen, in relation to the thickness and material of the front wall 616 of the box 612, so that the front wall 616 can be pushed into the gap 658 without requiring a force that might crumple the box material, but which form a restriction to removal. Preferably, the tips of the ribs 660 deflect, and/or the material of the front wall 616 compresses or bends slightly, to permit the passage of the front wall into the gap 658. However, if a force is applied tending to withdraw the rail 636, the ribs 660 act as barbs, to grip the front wall and resist removal. If the box 612 is made of paperboard, cardboard or similarly semi-flexible (or compressible) material, the ribs 660 may bite into the surface of the box material. Alternatively, an adhesive may be provided or some other securing method.

As shown in FIG. 33, the lip on the front wall 616 of the box 612 defines is relatively lower than the upper edge of the rear wall 620 and/or the end walls 614, so that when the front wall 616 is fully pushed into the gap 658 between the fins 656, the top of the actuation head 654 of the sliding cutter 648 is just below the top edges of the box ends 614. In this position, the box ends 614 may act as end stops, preventing the sliding cutter 648 from sliding out of the ends of the channel 638 of the cutter rail 636. The top 624 of the lid 622 is made slightly longer than the box ends 614, so that with the lid closed the flap 626 folds down in front of the cutter rail 636.

To assemble the container 610, the box 612 is formed and the roll 632 of web material 630 is placed in the box. The sliding cutter 648 is inserted in the rail portion 638 from one end, and the cutter rail 636 is pushed onto the box front wall 616. The lid 622 is closed over the cutter rail 636, and the tab 628 is secured to the lower part of the front wall 616, for example, by adhesive. The combination, thus, forms a compact sealed package, suitable for storage, shipping and display.

To open the container 610, the user may separate the flap 626 from the tab 628, or separate the tab 628 from the front wall 616. The separation may be irreversible, so that the container 610 can be re-closed loosely, but it is clear that the container has been opened and re-closed.

In use, the sheet material 630 is led off the roll 632 across the top surface 644 of the cutter rail 636, where it can be cut by the sliding cutter 648. Because the cutter rail 636 is centered over the box front wall 616, there is little tendency for the cutter rail 636 to tilt sideways and bend the box wall 616 if the user applies excess pressure to the cutter rail 636 or to the sliding cutter 648. The cutter rail 636 preferably overhangs the interior of the box 612 only slightly. Thus, the actuation head 654 does not overhang beyond the side walls 642 of the rail portion 638 and there is little risk of the roll 632 becoming entangled with the cutter assembly if the roll shifts out of position within the box.

The box portions of each embodiment discussed above may be made of paper, paperboard, cardboard, or the like. The boxes alternatively can be made from another substantially rigid material, such as, for example, plastic. The box could be made from two plies of 12 point or thinner material. It is contemplated that a thicker box construction would be more expensive to manufacture but would allow for the container to be reusable, whereas a thinner box construction would be less expensive to manufacture but would be more suitable for merely a one-time-use (or disposable) container. A reusable container may require more durable cutter blades than a disposable container. A metal cutter blade may be used, especially for a reusable container. A plastic blade may be more suitable for a disposable container.

Although elongate square and triangular dispensers have been described, the dispenser may be of any shape, provided that is capable of accepting a hollow core of web material and has surfaces and/or corners on which the slot for the web material and the rail and cutter assembly can be arranged. Thus, at a minimum, the dispenser must include a space capable of housing the web material. The dispenser may be circular in cross section. The dispenser can also be semi-cylindrical, rectangular, oval or some other geometrical or non-geometrical shape. As is shown for the triangular dispenser 110 in FIG. 6, terms such as "square" and "triangular" are not limited to the strict geometric shape, but include approximations thereto, whether arising from manufacturing tolerances and imprecision or from deliberate design choices such as the rounded corners shown in FIG. 6. The web of material could be in some form other than a roll. For example, the web of material may be folded back and forth on itself. If the web of material is in a form other than a roll, then the shape of the dispenser is not constrained to shapes that can efficiently contain a roll.

Various forms of slot have been described. In many cases, one form of slot may be substituted for another form, or a slot formed in the box of the container may be exchanged with a slot formed in the cutter rail, especially in those forms of cutter rail that extend from the actual cutter guide to engage a box side that is not continuous behind the cutter rail. The choice of slot may depend on whether it will be covered by a lid, cap, wrapper or the like. A slot that is closed until the container is brought into use as a dispenser, and is then opened, for example, by raising a flap or tearing out a strip, may be appropriate if the slot is not covered. In those drawings where a slot not shown or particularly mentioned, a suitable slot form is contemplated and may take the form of any of the other embodiments.

If the container is intended to be reusable, a lid or flap that can be opened and re-closed to insert a new supply of web material into the container may be desired. In those embodiments where such a flap is not shown, a flap may be provided on a convenient part of the box, for example, on a side not shown in the partial sections such as FIG. 27. Where the container is intended to be disposable, a flap may still be provided, to provide access to the interior to assist in initially feeding the web material through the slot. Alternatively, the container may be shipped with the free end of the web material already extending out through the slot, and secured on the outside of the box, especially if that part of the outside of the box is covered by a lid, etc.

Various embodiments show a rail mounted in a recess in the box with the ends of the rail received under an overhang, etc. at the ends of the box. Other embodiments show the ends of the rail open. In embodiments where the rail in its in use position is within the outline of the box, the ends of the box without overhangs may alternatively extend above the surface on which the cutter rail is mounted, and may then act as end-stops to prevent the cutter sliding out of the end of the rail. Alternatively, or in addition, the ends of the cutter rail may be closed by caps, or by deforming the rail, to retain the cutter within the rail. Alternatively, one or both ends of the rail may be left open.

In the embodiments, strips of cling, static cling, or tacky material may be provided to steady the web material while the material is being cut, and/or to retain the end of the material until it is drawn forward to cut a next length. For thick webs, and/or for web materials that do not cling strongly to the cling strips or other retentive materials, an entire side of the box may be coated with cling or other retentive material. The strip of the surface over which the underside of the cutter head actually passes may be left uncoated.

In the embodiments, the cutter rail is shown as a channel of C-shaped cross section, with a lengthwise slot, and with the web material being cut resting on the exterior surfaces either side of the slot. The corresponding cutter has a foot captive inside the channel, a neck carrying the actual cutter blade passing through the slot, and a head outside the channel that is grasped by the user. However, other configurations of cutter rail and cutter may be used.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dispenser for containing a supply of flexible web material and for dispensing a portion of the web material and severing the portion from the remaining web material in the dispenser, comprising:

a container formed by at least first, second, and third side walls serially connected to one another along longitudinal edges thereof that form corners of the container and a pair of opposite end walls connected to opposite end edges of the side walls, each of the side walls having at least a major portion that is substantially planar and is angularly oriented relative to the side walls adjacent thereto, the planar major portions of the side walls defining an external geometric profile of the container;

an elongate opening defined in one of the side walls through which a portion of the web material can be dispensed;

one of the corners of the container defining a recessed area formed by a first wall portion that connects with the first side wall and a second wall portion that connects with the second side wall, the first and second wall portions extending inwardly away from the external geometric profile and toward an interior of the container and being connected to each other at a concave corner, such that the recessed area is inside the external geometric profile, the first and second wall portions extending longitudinally for a length that is less than a distance from one end wall to the other end wall;

a polymer track affixed to the container and disposed in the recessed area such that the track is inside the external geometric profile, the cutter track having a length substantially as long as the distance from one end wall to the other end wall;

a cutter engaged with the track and slidable therealong for cutting a portion of web material dispensed through the elongate opening and laid across the track, wherein the cutter is entirely inside the external geometric profile; and wherein each of the opposite ends of the track is overhung by first and second non-recessed portions of the first and second side walls, respectively, the first and second non-recessed portions each being joined to an adjacent one of the end walls and extending longitudinally partway along the distance from said adjacent end wall toward the other end wall.

2. The dispenser of claim 1, wherein finger openings are defined through the container adjacent the elongate opening.

3. The dispenser of claim 1, wherein the track is adhered to at least one of the first and second wall portions forming the recessed area.

4. The dispenser of claim 3, wherein the track has a base portion and a rail portion joined to the base portion, the base portion having a generally triangular cross-sectional shape and being adhered to the first and second wall portions adjacent the concave corner therebetween such that the rail portion is obliquely oriented relative to each of the first and second wall portions.

5. The dispenser of claim 4, wherein the base portion of the track is formed in part by two walls that extend obliquely relative to the rail portion and that have distal edges that are spaced apart to define a gap therebetween.

6. The dispenser of claim 4, wherein the base portion of the track is formed in part by two walls that extend obliquely relative to the rail portion and that have distal edges that are joined together.

7. The dispenser of claim 1, wherein the container has a generally triangular cross-sectional shape.

8. The dispenser of claim 1, wherein the container includes a fourth side wall and has a generally square or rectangular cross-sectional shape.

9. The dispenser of claim 1, further comprising a removable cover that covers the track and cutter.

* * * * *